US005342033A

United States Patent [19]

Iwata et al.

[11] Patent Number: 5,342,033

[45] Date of Patent: Aug. 30, 1994

[54] CONTROL METHOD FOR SHEET DISCHARGER WITH STAPLER

[75] Inventors: Masakatsu Iwata; Takeyoshi Kobashi, both of Yokohama, Japan

[73] Assignee: Canon Kabushiki Kaisha, Tokyo, Japan

[21] Appl. No.: 133,215

[22] Filed: Oct. 7, 1993

Related U.S. Application Data

[60] Division of Ser. No. 953,288, Sep. 30, 1992, which is a continuation of Ser. No. 583,005, Sep. 17, 1990, abandoned, which is a continuation of Ser. No. 228,442, Aug. 5, 1988, abandoned.

[30] Foreign Application Priority Data

| | | | |
|---|---|---|---|
| Aug. 7, 1987 | [JP] | Japan | 62-196436 |
| Aug. 7, 1987 | [JP] | Japan | 62-196437 |
| Aug. 7, 1987 | [JP] | Japan | 62-196438 |
| Aug. 7, 1987 | [JP] | Japan | 62-196439 |
| Aug. 7, 1987 | [JP] | Japan | 62-196440 |
| Aug. 7, 1987 | [JP] | Japan | 62-196441 |
| Aug. 7, 1987 | [JP] | Japan | 62-196442 |
| Aug. 19, 1987 | [JP] | Japan | 62-206125 |
| Aug. 27, 1987 | [JP] | Japan | 62-214052 |
| Aug. 27, 1987 | [JP] | Japan | 62-214053 |
| Oct. 20, 1987 | [JP] | Japan | 62-265137 |

[51] Int. Cl.[5] ..... B42B 2/00; G03G 21/00; B21J 15/28

[52] U.S. Cl. ..... 270/53; 355/324; 227/2; 227/131

[58] Field of Search ..... 270/53; 227/2, 137; 355/324

[56] References Cited

U.S. PATENT DOCUMENTS

| | | | |
|---|---|---|---|
| T958,003 | 5/1977 | Russel et al. | 227/2 X |
| 4,134,672 | 1/1979 | Burlew . | |
| 4,244,564 | 1/1981 | Brown | 270/53 |
| 4,358,197 | 11/1982 | Kukucka et al. . | |
| 4,424,963 | 1/1984 | Bartholet et al. | 270/53 |
| 4,523,750 | 1/1985 | Hubler . | |
| 4,566,782 | 1/1986 | Britt . | |
| 4,603,971 | 8/1986 | Kukucka . | |
| 4,605,211 | 8/1986 | Sonobe . | |
| 4,797,832 | 1/1989 | Axelrod . | |
| 4,917,366 | 4/1990 | Murakami et al. . | |
| 4,989,852 | 2/1991 | Gunther, Jr. . | |
| 5,032,876 | 7/1991 | Murakami | 355/324 |
| 5,190,274 | 3/1993 | Kamamoto et al. | 270/53 |

FOREIGN PATENT DOCUMENTS

| | | |
|---|---|---|
| 0028163A | 5/1981 | European Pat. Off. . |
| 0054351A | 6/1982 | European Pat. Off. . |
| 0186434A | 7/1986 | European Pat. Off. . |
| 2732673A | 9/1978 | Fed. Rep. of Germany . |
| 2732673 | 9/1978 | Fed. Rep. of Germany . |
| 3234746 | 3/1984 | Fed. Rep. of Germany . |
| 3234746A | 3/1984 | Fed. Rep. of Germany . |
| 3304873 | 8/1984 | Fed. Rep. of Germany . |
| 3304873A | 8/1984 | Fed. Rep. of Germany . |
| 62-38656 | 2/1987 | Japan . |
| 62-126766 | 6/1987 | Japan . |

*Primary Examiner*—Edward K. Look
*Assistant Examiner*—John Ryznic
*Attorney, Agent, or Firm*—Fitzpatrick, Cella, Harper & Scinto

[57] ABSTRACT

A method of controlling a sheet material discharge apparatus with a sheet material binder includes, during discharge of sheet materials which form a set, the binding means operates to bind the set without waiting for a trailing edge of the last one of the sheet materials of the set to be discharged, once a leading edge of the last sheet is discharged and aligned in a sheet accommodating step, and after operating a binding means to bind a set, detecting a resetting of the binding means to a standby state, and permitting the operation of the sheet discharging operation when the resetting is not detected within a predetermined period after operation of the binding means is instructed.

4 Claims, 16 Drawing Sheets

CONTROL METHOD FOR SHEET DISCHARGER WITH STAPLER

This application is a division of application Ser. No. 07/953,288 filed Sep. 30, 1992, which is a continuation of application Ser. No. 07/583,005 filed Sep. 17, 1990, now abandoned, which is a continuation of application Ser. No. 07/228,442 filed Aug. 5, 1988, now abandoned.

FIELD OF THE INVENTION AND RELATED ART

The present invention relates to a control method for a sheet discharger and an image recording apparatus using the same for sequentially discharging recording sheets or printed sheets such as a facsimile machine or a printer for a computer.

The following description will be made with respect to a facsimile machine as an exemplary image recording apparatus.

A typical facsimile machine contains a roll of paper as a recording material, which is unwound while the receiving image information is being recorded; and each time the image information corresponding to one page of the original transmitted from a sender is recorded, cutter means is actuated to cut the recorded part of the paper out of the remainder to discharge a cut sheet.

The output may include one sheet per one communication or may be plural sheets (a set of plural pages) per one communication.

If the discharged sheets are not removed each time one communication is received, the recorded communications from different senders and having different pages are simply stacked sequentially. This frequently occurs if the facsimile machine is set to an automatic receiving more at night or on holidays or the like.

If various recorded sheets of communications are sent from different senders and have different number of pages, it is difficult to sort them afterwards, and they are erroneously sorted sometimes.

SUMMARY OF THE INVENTION

Accordingly, it is a principal object of the present invention to provide a control method for a sheet discharging apparatus such as a facsimile machine wherein the discharged sheets are easily handled.

According to an embodiment of the present invention, the sheet discharger is provided with a sheet binder such as a stapler in a means for accommodating the discharged or output sheet to staple the output sheets for each set, wherein a bound portion of bound sheets is displaced from a binding position, and thereafter, next discharged sheets and allowed to be stapled, and wherein the stapled sets of sheets are accommodated together, that is, overlaid, stacked or vertically.

According to an embodiment of the present invention, there is provided a sheet discharger such as a facsimile machine, wherein the recorded sheets sequentially discharged upon reception of information are stacked in alignment with each other by abutting one edge thereof to a stopper. When one received communication includes plural recorded output sheets, the one set of the output sheets are bound by operating a sheet binder after the last page of the communication is discharged. This is effected under the control of a sheet binder control means. Therefore, even if the output sheets of plural communications from different sender and having different pages are sequentially discharged, they are automatically bound for each of the communications, so that the later sorting work is easy without an error.

According to an embodiment of the present invention, the sheet discharger is provided with a sheet pusher for pushing a staple set of output sheets outwardly. Therefore, the stapled sheets or the sheet not to be stapled are pushed out of a stapling station where the stapler operates, and therefore the next stapling operation for the next set of the sheets are not obstructed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
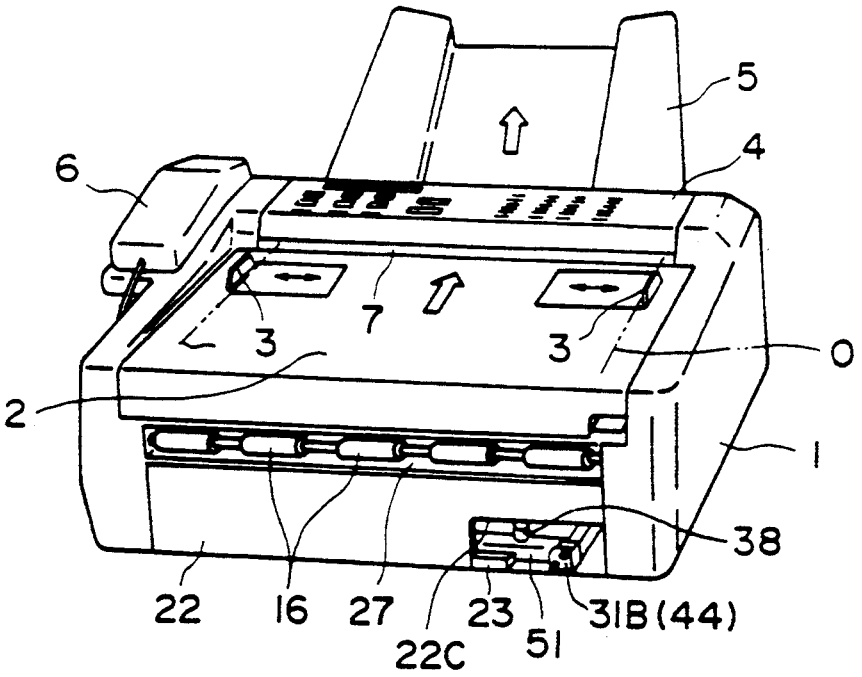
FIG. 1 is a perspective view illustrating an external appearance of a facsimile machine provided with a stapler according to an embodiment of the present invention.
Figure 2:
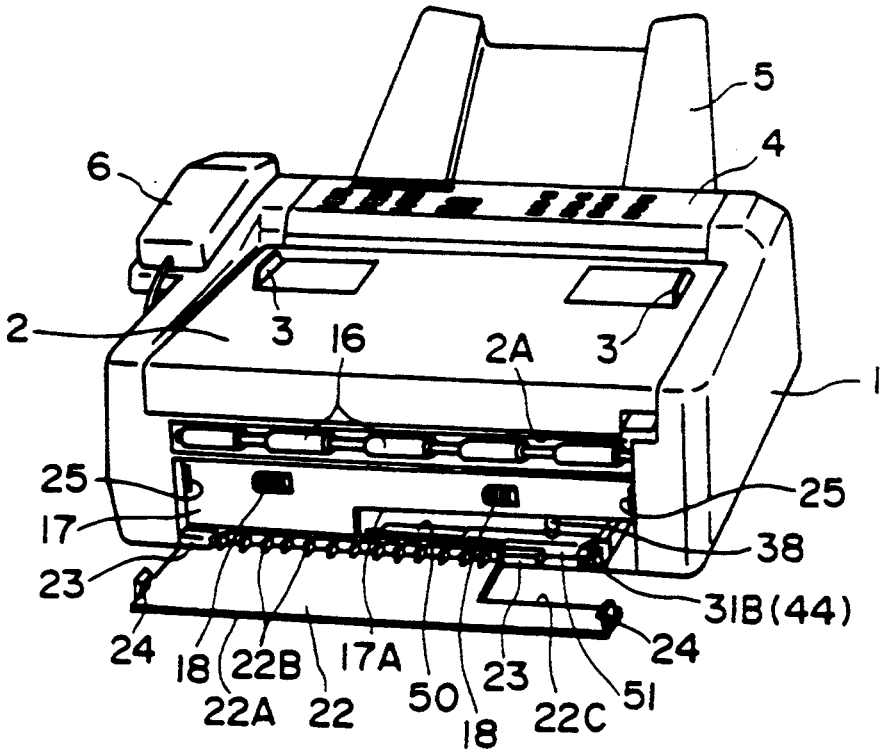
FIG. 2 is a similar perspective view wherein sheet holding cover at the front side of the machine is opened.
Figure 3:
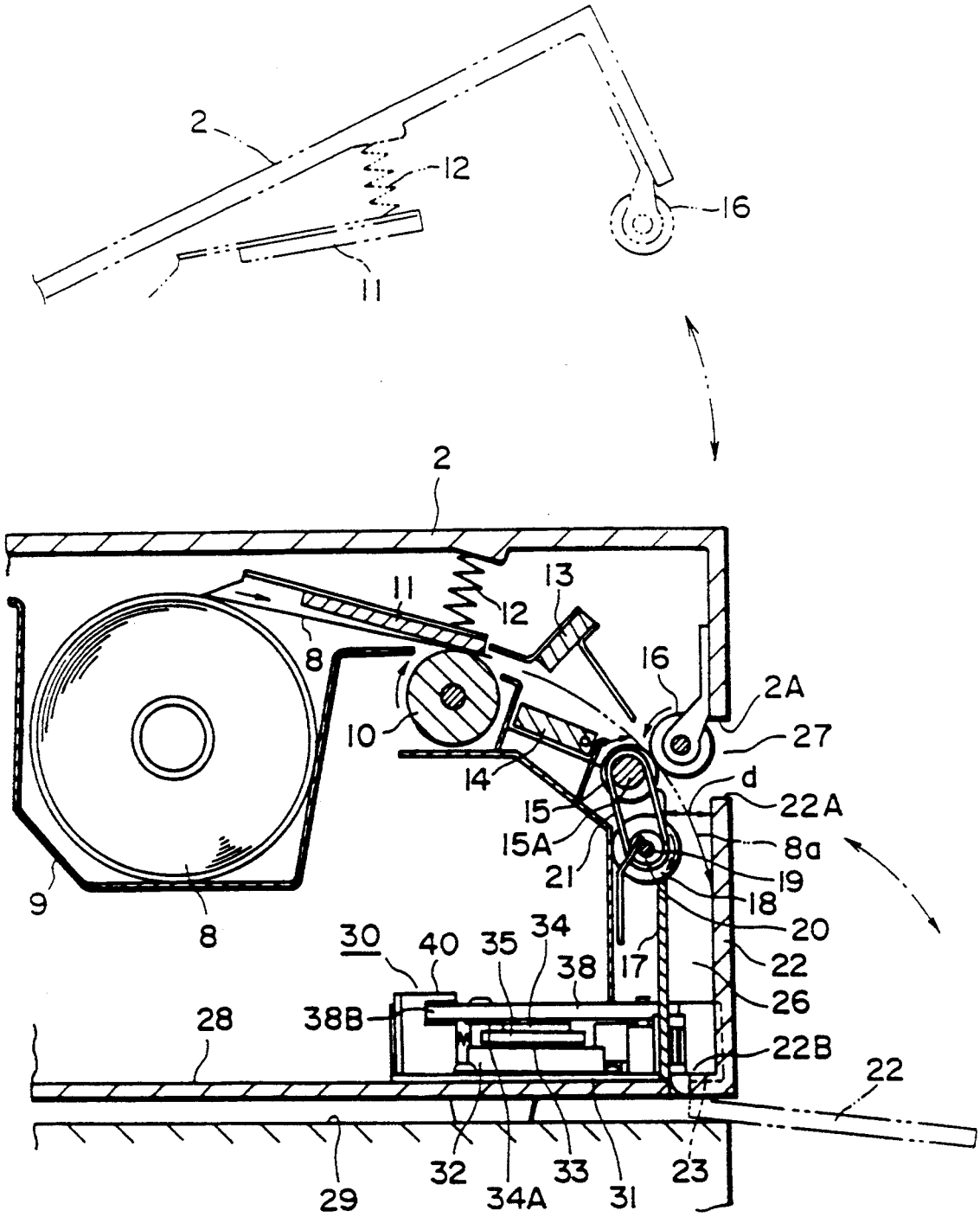
FIG. 3 is an enlarged cross sectional view of recording and sheet discharging mechanisms of the machine.

Referring to FIGS. 1, 2 and 3, a facsimile machine provided with a stapler according to an embodiment of the present invention will be described. FIG. 1 shows an outer appearance; FIG. 2 shows an outer appearance wherein the sheet holder cover at the front side of the apparatus is opened; and FIG. 3 is an enlarged cross sectional view of the recording and sheet discharging mechanisms.

A. Information Transmitting Structure

Referring to FIG. 1, the facsimile machine includes an outer casing 1, a top cover which also functions as a platen on which an original (sheet original) O to be sent is placed, guiding plates 3, 3 provided on the top cover 2 to guide the original at the lateral edges, the guiding plates being movable or slidable to control the distance between the guiding plates in accordance with a width of the original O, an operation panel 4 (console panel), a discharge tray 5 for receiving the originals having been transmitted and a telephone receiver 6. An or plural originals O having an image or images to be transmitted are placed face down on the top cover with its or their leading edges being sufficiently inserted into a clearance 7 formed between the operating panel 4 and a rear side of the top cover 2. When a starting button is depressed, the original O is pulled into the machine under the operation panel by unshown rollers disposed under the operating panel 4 at a predetermined speed with its center lines being aligned with a reference. When the plural originals O are placed, the bottommost one of the originals are first separated and pulled in. The original being pulled is photoelectrically read by unshown photoelectric leading means from the reading edge to the trailing edge of the original to produce time series electric picture element signals, which are transmitted to a receiver machine. The original having been read is discharged onto the tray 5.

B. Information Receiver Structure

Referring to FIG. 3, the facsimile machine contains thermo-sensitive recording paper in the form of a roll accommodated in the sheet container 9. The above-described top cover 2 is openable by releasing unshown locking means and swinging the top cover 2 about a hinge (not shown) at a rear side, as shown by chain lines. With the top cover 2 opened, the rolled recording paper 8 is placed into the container 9. After the rolled paper is accommodated therein, a leading edge thereof is partly unwound to a top surface of a platen roller 10, and then the top cover is closed. When the top cover 2 is completely closed, the locking means operates to maintain it in the closed state shown by the solid lines. By this, a surface of an array of heat generating elements of a heat generating element array assembly (recording head) 11 functioning as recording means, provided on an inside of the top cover 2, is brought into press-contacted to the top surface of the platen roller 10 with the recording paper 8 therebetween. The recording head 11 is press-contacted to the top surface of the platen roller 10 by an urging spring 12.

A paper cutter is disposed adjacent to the platen roller 10 and includes a stationary blade 13 and a movable blade 14. A couple of sheet discharging rollers 15 and 16 are disposed adjacent to the cutter, and the lower roller 15 is a driving roller rotationally driven in the direction of an arrow, whereas the upper roller 16 is a follower roller driven by the lower roller 15. The follower roller 16 is mounted to the top cover 2 and is brought into press-contact to the driving roller 15 when the top cover is closed.

The machine is provided with a front wall 17 of the main frame of the facsimile machine. As shown in FIG. 2, friction rollers 18 and 18 made of rubber or the like are mounted with external parts thereof projected outside the front wall 17 at left and right portions of the wall 17. The rollers 18 and 18 are supported on a shaft 19 through one way clutches 20, respectively. An outer ring of the one way clutch 20 is connected with a shaft 15A of the driving roller 15 of the discharging roller couple by a belt 21, so that when the shaft 15A of the driving roller 15 is rotated, the friction rollers 18 and 18 are rotated in the same direction as the driving roller 15.

If, on the contrary, the friction rollers 18 and 18 receive an external force for the rotation in the opposite direction, they do not rotate in that direction because of the provision of the one way clutch 20.

A holder plate 22 is disposed outside the front wall 17 to hold the recorded sheets (received sheets). The holder plate 22 is swingable about hinge portions 23 and 23 at the bottom left and right portions between a closed position wherein it extends substantially parallel with the front wall 17 as shown in FIGS. 1 and 3 and an open position wherein it has fallen forwardly as shown by chain lines in FIGS. 2 and 3. Normally, it is maintained in the closed position by locking means, more particularly, by engagement between a resilient pawls 24 and 24 and corresponding holes 25 and 25 provided at left and right end portions of the holder plate 22 and the front wall 17 correspondingly thereto, as shown in FIG. 2. In this state, a cavity 26 opening upwardly is formed between those plates 17 and 12 with the clearance d, and it functions as a recorded sheet stacker (sheet receiving portion). A sheet outlet 27 is formed between a top edge *22a* of the holder plate 22 which takes the closed position and a bottom edge 2A of a downwardly bent portion at the front side of the top cover 2 which takes the closed position. Reference numerals 28 and 29 designate a bottom frame and a pedestall surface on which the facsimile machine is placed, respectively.

The operation of the machine will be described.

(1) In response to a record starting signal for the image information which is being received, the platen roller 10 is intermittently driven by an amount corresponding to one line of the information. The paper discharging rollers 15 and 16 are driven at a predetermined peripheral speed in the direction of an arrow. The friction rollers 18 and 18 are also driven in the direction indicated by an arrow in response to the rotation of the roller 15.

The leading edge portion of the rolled thermosensitive recording paper 8 is sandwiched between the top surface of the platen roller 10 and the recording head 11. Therefore, when the platen roller 10 is intermittently rotated by the amount of one line recording, a pulling force is applied to the paper 8, so that the rolled paper rotates in the container 9 in the unwinding direction, by which the rolled paper is intermittently unwound. In the process of the unwound part of the paper being intermittently fed by one line recording through the recording station, that is, between the platen roller 10 and the recording head 11, each of the heat generating elements of the recording head 11 is controlled in the heat generation, corresponding to the time series electric picture element signals indicative of the image formation receiving from the sender. By this heat generation control, information corresponding to the received image information is sequentially recorded one line by one line on the top surface of the unwound paper.

(2) The recorded part of the paper is passed through the clearance between thestationary blade 13 and the movable blade 14 of the cutter and is caught by the nip formed between the discharging rollers 15 and 16, by which the paper is discharged inclinedly and substantially downwardly. Then, the paper is advanced into the upwardly opening cavity 26 (stacker portion) constituted by the front wall 17 and the holder plate 22 in the closed state. More particularly, the leading edge of the recorded part of the paper is advanced into the cavity 26 downwardly, as shown by chain lines 8*a* in FIG. 3.

Figure 4A:
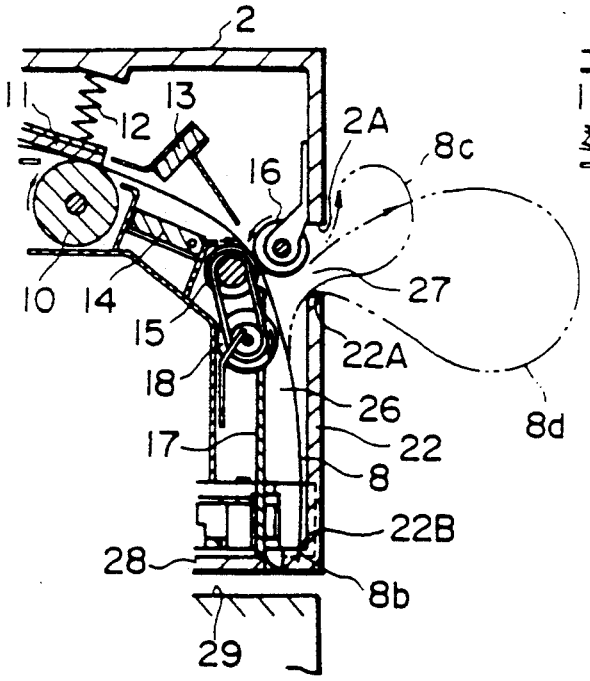
FIGS. 4A, 4B, 4C and 4D illustrate sheet discharging process of recorded sheets.

(3) By the continuing feeding of the paper, the leading edge 8*b* of the recorded part of the paper now in the cavity 26 is brought into abutment with the bottom surface 22B which functions as a stop member formed toward the inside at a bottom portion of the holder plate 22, as shown in FIG. 4A, by which the leading edge of the paper is prevented from further advancement in the cavity 26.

(4) Thereafter, the recorded part further advanced by the rollers 15 and 16 is outwardly looped between the top edge 22A of the holder plate 22 and an upper one 16 of the rollers 15 and 16 to form a loop extending outwardly through the recording paper outlet 27, as shown by chain lines 8*c* in FIG. 4A. The loop becomes larger as shown by reference 8*d* together with the continuing discharging advancement of the recorded part of the paper.

Figure 4B:
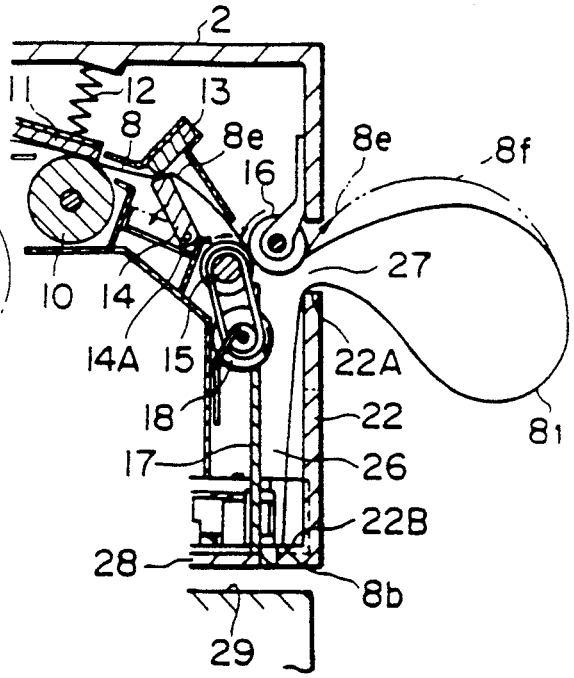

(5) When the recording of one page is completed, and the trailing edge of the recorded part of the paper reaches between the cutter blades 13 and 14, the movable blade 14 is rotated in the clockwise direction about the shaft 14A to the stationary blade 13, as shown in FIG. 4B, and then is returned, by which the part $8_1$ (received paper) now having image recording for one page is cut from the remainder of the rolled paper 8.

(6) The trailing edge portion 8*e* of the cut sheet $8_1$ is continuously advanced by the rollers 15 and 16. The platen roller 10 is rotated reversely after the paper is cut, so that the leading edge portion of the rolled paper is fed back so that the leading edge thereof is retracted to the contact position between the platen roller 10 and the heating generating element array 11, and then the reverse rotation of the platen roller 10 is stopped.

(7) The trailing edge portions of the recorded cut sheet $8_1$ having passed through the rollers 15 and 16 is spontaneously poped out through the sheet outlet 27, as shown by chain lines 8*f* in FIG. 4B, due to the weight of the part of the sheet projecting outwardly through the sheet outlet 27 in the form of a loop and the resiliency of the looped paper.

Figure 4D:
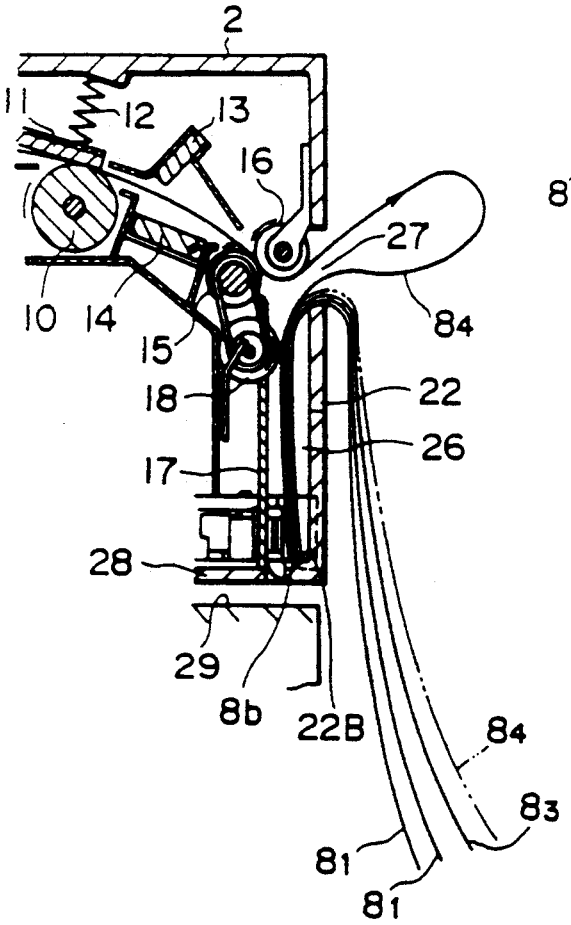
Figure 4C:
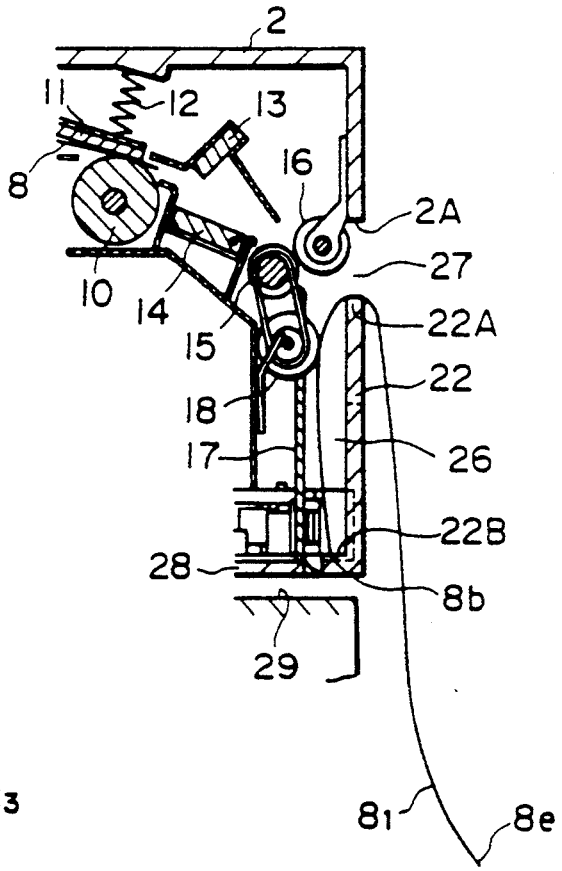

The part of the sheet extending outwardly through the sheet outlet 27 bends by its own weight in the form of reversed U at the top edge 22A of the holder plate 22 by its weight and is suspended outside the holder plate 22, as shown in FIG. 4C.

The recorded cut sheet $8_1$ (received sheet) having a trailing side portion 8*e* which is suspended outwardly of the holder plate 22 through the sheet outlet 27 is sufficiently inserted into the cavity 26 by its leading edge 8*b* abutted to the bottom surface 22*b* functioning as the stopper member. The sheet is stably supported in the suspended state shown in FIG. 4C without spontaneously falling therefrom, because the portion of the cut sheet at the sheet outlet 27 is bent in a small curvature and is hung on the top edge 22A of the holder plate and because a part of the sheet in the cavity 26 is contacted to the outer surface of the friction rollers 18 and 18 to provide a friction force preventing the sheet from falling.

(8) The above steps 1–7 are repeated for a second page, a third page and subsequent pages, if any. The cut sheets of those pages are overlaid on the already outputted sheet on the holder plate 22 through the sheet outlet 27 and are held in the similar manner. FIG. 4D shows the state wherein the cut sheet $8_1$, $8_2$ and $8_3$ for three pages are sequentially overlaid with their leading sides in the cavity 26 and with the trailing sides suspended outside the holder 22 through the sheet outlet 27, and wherein the fourth page $8_4$ is being discharged. The leading edges 8*b* of the sheets $8_1$, $8_2$ and $8_3$ are abutted to the bottom 22B functioning as the stop member so that the sheet are aligned thereby.

C. Sheet Binder Means

The sheet binding means is a means or mechanism which is actable on the recorded sheets (received sheets) $8_1$, $8_2$, $8_3$. . . which have been sequentially discharged from the machine and are overlaid and held by a holder portion in the manner shown in FIG. 4D, for example, and which automatically binds a plurality of recorded sheets which should constitute one set, thus distinguishing the set from the other output sheets.

Referring to FIG. 3, the binder means is designated by a reference 30 as being disposed on the base 28 of the machine. In this embodiment, the binder means is a stapler unit.

Figure 5:
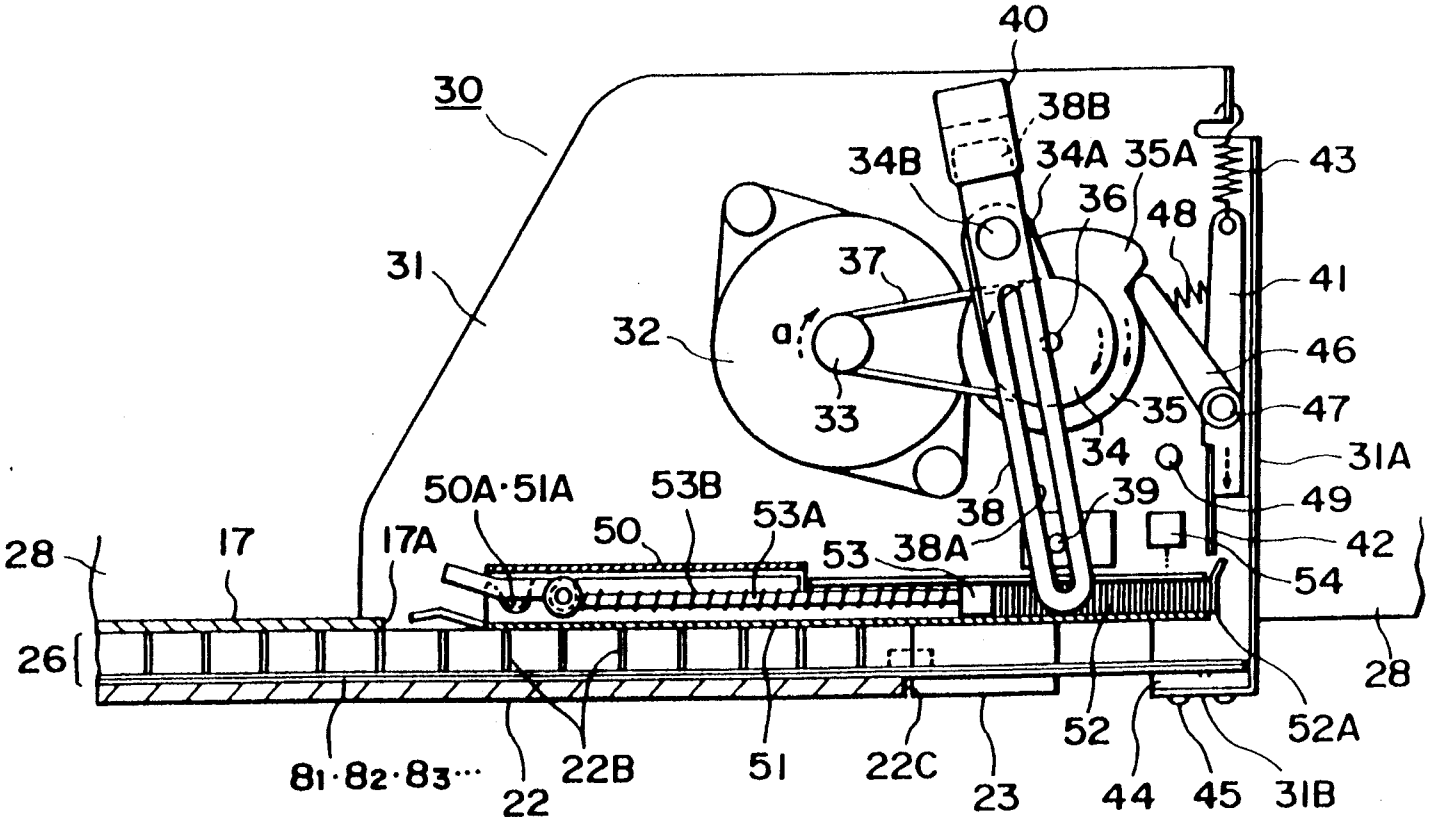
FIGS. 5, 6 and 7 are enlarged top plan views illustrating operational process of a stapler unit.

FIG. 5 shows an enlarged top plan view partly broken. The stapler unit comprises a stapler base plate 31, a reversible motor (stapler motor) mounted on the base plate 31 with its output shaft 33 extending upward, a pulley 34 rotatable about a shaft 36 extended from the base plate 31, a cam plate integrally mounted on the pulley at its bottom side, and a cam pawl 35*a* of the cam plate 35. The unit further includes a belt trained between the output shaft 33 of the motor 32 and the pulley 34 to transmit the rotational force, an outwardly projected crank arm integral with the pulley 34, a crank pin 34B planted in the arm, an elongated reciprocable arm rotatably supported on the crank pin to push a sheet out (sheet releasing means), and a slit 33A formed in the reciprocable plate or arm extending longitudinally. A pin 39 is planted at a predetermined position of the base plate 31 extending upwardly, and the slit 38A of the elongated reciprocable arm 38 is engaged therewith. Designated by a reference 40 is a stapler sensor, more particularly, a microswitch or a photoelectric sensor or the like, for example. The sensor is effective to define a reference rotational angular position of the pulley 34 and the cam plate 35, and is effective to detect staple jam which will be described hereinafter. The sensor 34 is disposed at a predetermined position of the base plate 31.

The base plate 31 is upwardly bent at the right side thereof to form a side wall 31A. The inside surface of the side wall 31A functions as a guiding surface for guiding a slider 41 in the forward and backward directions. A stapler hammer 42 is projected from the leading edge of the slider. The slider 41 is normally urged toward the retracted position by a tension spring 43. The leading edge portion of the side wall 31A is extended forwardly, and the extended portion is bent at right angles to form an anvil mount plate 31B. An anvil 44 for bending legs of a staple is securedly fixed on an inside surface of the mounting plate 31B by screws 45. An operating arm actable on the cam plate 35 is rotatably mounted on the slider 41 by a pin 47 at its base portion. The arm 46 is normally rotationally urged to the cam plate by a pushing spring 48. A stopper pin 49 is effective to interfere with the operating arm 46, and is planted on the base plate 31 at a predetermined position.

A staple magazine mount 50 is fixed on the base plate 31 at its front side along the front edge. The mount is in the form of a channel (FIG. 9) opening toward the front. Into the mount 50, a staple magazine 51 extending laterally is inserted at its trailing portion. The magazine 51 contains a lot of staples 52. A stapler feeder 53 is slidable along a guiding rod 53A and is urged by a coil spring 53B enclosing the guiding rod 53A to urge the lot of the staple 52 to the leading edge in the magazine 51.

Figure 9:
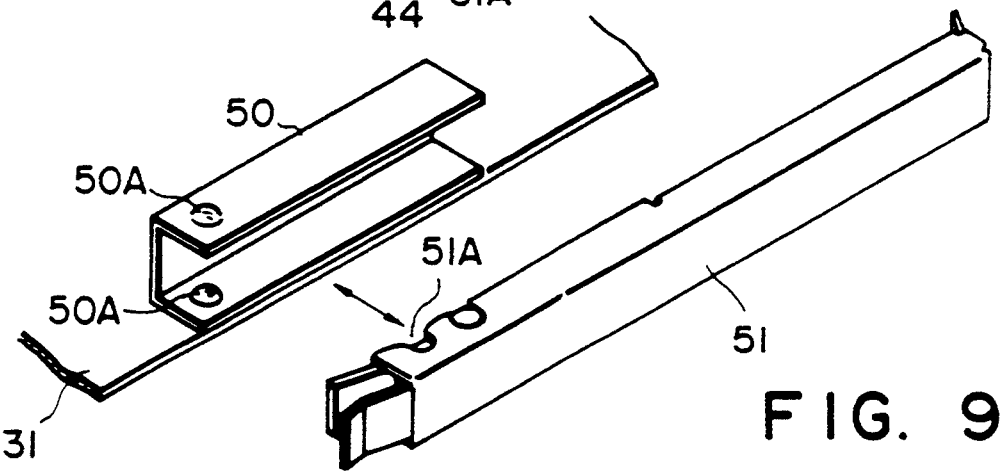
FIG. 9 is a perspective view of a stapler magazine and a magazine mount.

FIG. 9 is a perspective view of the staple magazine mount 50 and a staple magazine 51 removed therefrom. The mount 50 has a top plate and a bottom plate, and small convex portions toward the inside and toward the each other formed by a press at left portions of the top plate and the bottom plate. Correspondingly, the staple magazine 51 has a top plate and a bottom plate, and a cut-away portions 51A (51A) engageable with the small convex portions of the magazine mount 50. The staple magazine 51 is mounted to the mount 50 by pushing the magazine 51 into the mount 50 so that the cut-away portions 51A (51A) of the magazine 54 is engaged with the small convex portions 50A and 50A of the mount 50. When the magazine 51 is mounted thereinto, it is rotatable about the small convex portions 50A and 50A.

A staple sensor 54 of a reflection and photoelectric type is disposed at a predetermined position in the base plate 31 corresponding to a leading side of the staple magazine 51 to detect a remaining amount of the staples.

Figure 10:
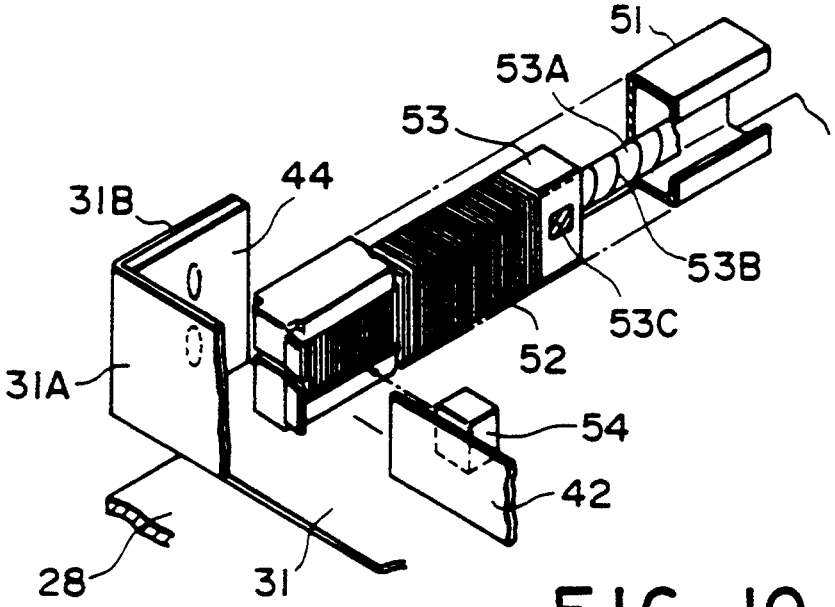
FIG. 10 is a perspective view of a sensor for sensing the remainder of staples.

FIG. 10 shows a perspective view of the sensor. When the staples are consumed in the staple magazine 51, and the remaining amount reaches a predetermined, or when the staple magazine 51 is empty, a reflection surface 53C on a surface of the staple feeder 51 comes to a position to face the sensor 54, so that light emitted from the sensor 54 is reflected by the reflection surface 53C and is received by a light receiving element of the sensor 54. By this, the shortage or absence of the staples is detected.

The stapler unit 30 is disposed in the cavity 26 (stacker portion) for receiving and supporting the leading sides of the output sheets $8_1$, $8_2$ and $8_3$. An inside of the anvil 44 of the stapler unit 30 is disposed to a right corner, adjacent the leading edges, of the recorded sheets $8_1$, $8_2$, $8_3$ . . . received in the cavity 26 with their leading edge abutted to the bottom surface 22B functioning as the stopper. The base plate 31 of the stapler unit 30 is securedly fixed to the top surface of the machine base 28 so that the staple magazine mounted in the mount 50 extends at the inside of the front wall 17 of the machine and substantially parallel therewith.

In the stapler unit 30, the anvil 44 or the staple hammer mechanism or the like receive a fairly great shock upon the stapling operation. Therefore, the stapler unit 30, or at least the anvil 44 is securedly fixed to a frame such as the base 28 of the machine (facsimile machine) which is a strong supporting member.

The part of the front wall 71 to which the staple magazine 51 is opposed, is cut away to form a window 17A. Correspondingly, the recording sheet holder plate 22 is cut away at a portion corresponding to the anvil 44 and a generally front half portion of the staple magazine 51 to form a window 22C. The staple magazine 51 is mounted into or dismounted from the mount 50 through the window 17A of the front wall 17, when the holder plate 22 is opened, as shown in FIG. 2.

The stapling operation will be described.

(1) FIG. 5 shows the stapling mechanism in the standby state. The motor 32 is not energized, and the pulley 34, and therefore, the cam plate 35 is stopped at a reference rotational angular position. The elongated reciprocable arm 38 functioning as a sheet retracting means takes the most retracted position by the crank arm 34A taking a rearward angular position. The trailing edge portion 38B of the reciprocable arm 38 is opposed to the sensor 40. The slider 41 provided with the hammer 42 takes the retracted position by the spring 43 wherein the operating arm 46 is contacted to the low level portion of the cam plate 35.

(2) Upon generation of a stapling signal, the motor 32 starts to rotate in the forward direction. By this, the motor output shaft 33 rotates in the clockwise direction a, by which the pulley 34, the cam plate 35 rotates in the clockwise direction about a shaft or pin 36. By the forward rotations of the pulley 34 and the cam plate 35, the leading edge of the operating arm 46 of the slider 41 is pushed by the cam pawl portion 35A of the cam plate 35. By the pressing force, the slider 41, and therefore, the stapler hammer 42 is advanced to the leading edge portion of the staple magazine 51 against the spring 43.

Figure 6:
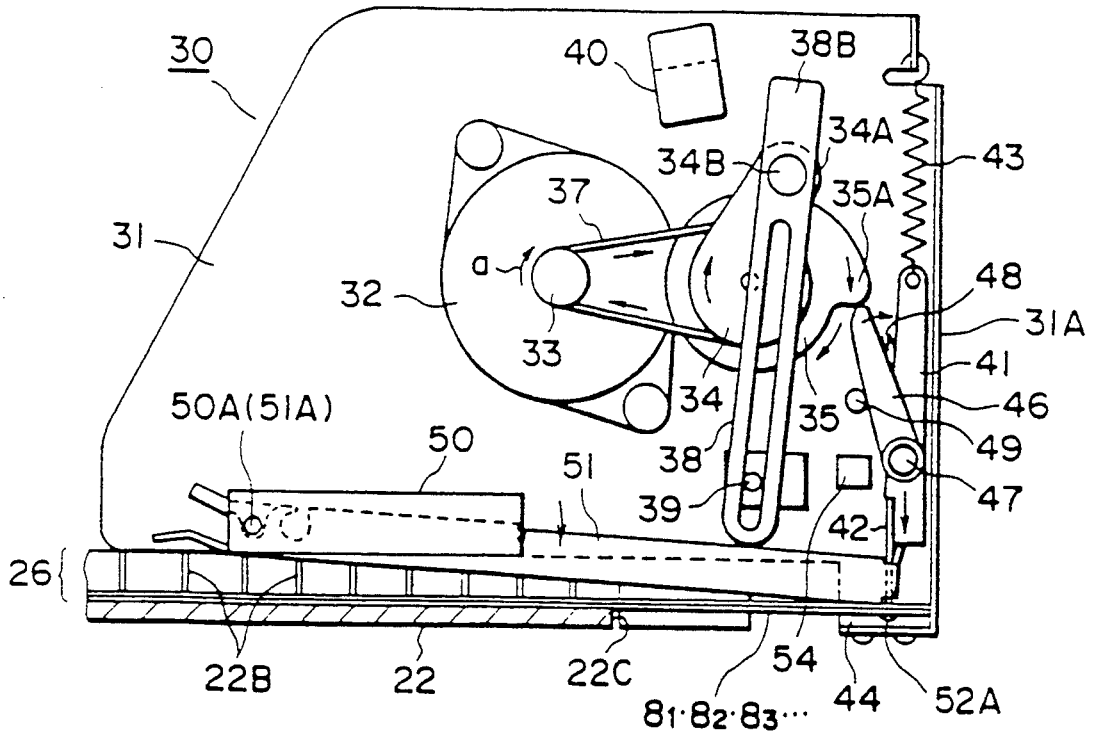

During the advancing process, the leading edge of the hammer 42 abuts to the top of a first staple 52A of the lot of the staples loaded in the staple magazine 51. This rotates the staple magazine 51 about the small convex portions 50A and 50A adjacent the trailing edge thereof so that the staple outlet adjacent the leading edge is abutted to the anvil 44 with the output sheets $8_1$, $8_2$ and $8_3$ . . . sandwiched therebetween, the sheets being a set of sheets having leading edges **8*b* abutted and aligned to the bottom surface 22B. The slider 41 is further advanced continuously to advance the staple hammer 42 to push the first staple 52A out of the staple magazine 51 so that the legs of the staple penetrate the sheet $8_1$, $8_2$, $8_3$ . . . and are bent toward each other by the anvil 44, that is, the sheets are stapled. In FIG. 6**, the sheets have been stapled. In this manner, the output sheets $8_1$, $8_2$, $8_3$ . . . which should constitute a one set of sheets are bound.

The stapling operation provided by the advancement of the slider 41 is completed by the rotations of the pulley 34 and the cam plate 35 through about 45 degrees. The operating arm 46 of the slider gradually rotates toward the slider 41 against the spring 48 by its contact to the stopper pin 49 during the 45 degrees rotation of the cam plate 35. At the termination of the 40 degrees rotation of the cam plate 35, the leading edge of the operating arm 46 is contacted to the highest level portion of the cam pawl 35A, and the engagement with the cam pawl portion 35A is released, so that the pressing force to the operating arm 46 by the cam pawl portion 35A is removed. By this, the slider 41, and therefore, the staple hammer 42 is retracted toward the retracted position by the spring 43. Together with the reciprocal movement of the staple hammer 42, the staple hammer 42, the staple magazine 51 is rotated back about the small convex portions 50A and 50A at the rear side.

Figure 7:
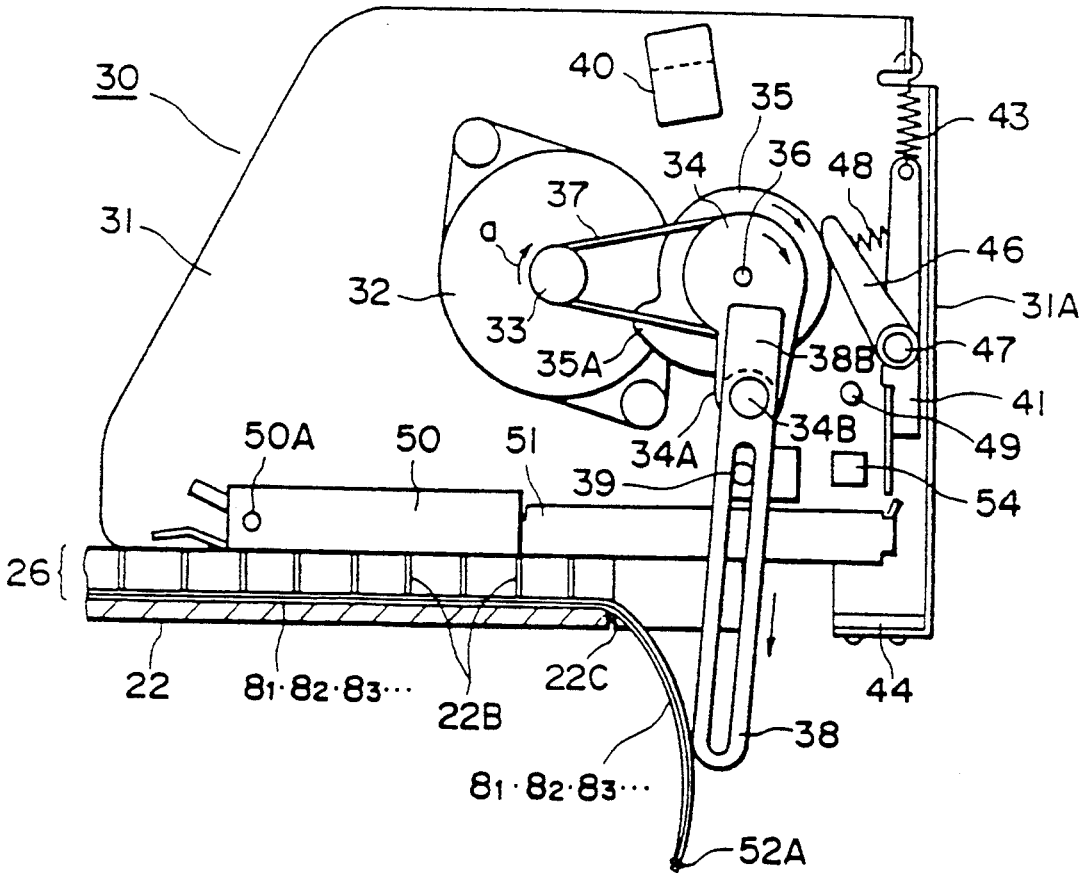

(3) The forward rotations of the pulley 34 and the cam plate 35 further continue, and during the forward rotation, the reciprocable arm 38 is advanced by the rotation of the crank arm 34A and the crank pin 34B. By the advancement, its leading edge is projected outwardly toward the front side of the machine, as shown in FIG. 7, through the window 17A of the front wall 17 of the machine and the window 22C of the holder plate 22. The amount of projection becomes maximum when the pulley 34 and the cam 35 rotates by about 200 degrees from the reference rotational angular position shown in FIG. 5.

By the projection operation of the reciprocable arm 38, the leading right corner of the stapled sheets $8_1$, $8_2$ and $8_3$ is projected outwardly through the window 22C of the holder plate 22, so that the leading right corner of the sheets stapled by the staple 52A are pushed outwardly from the inside .of the anvil 44.

(4) The rotations of the pulley 34 and the cam plate 35 are further continued, and the reciprocable elongated arm 38 is retracted until they completes its one full rotation (360 degrees) upon completion of the one full turn of the pulley 34 and the cam plate 35, the trailing edge 38B of the reciprocable arm 38 is opposed to the sensor 40, and this event is transmitted as a feed back signal to a control circuit, in response to which the motor 32 is stopped to restore the stand-by position shown in FIG. 5.

Figure 8:
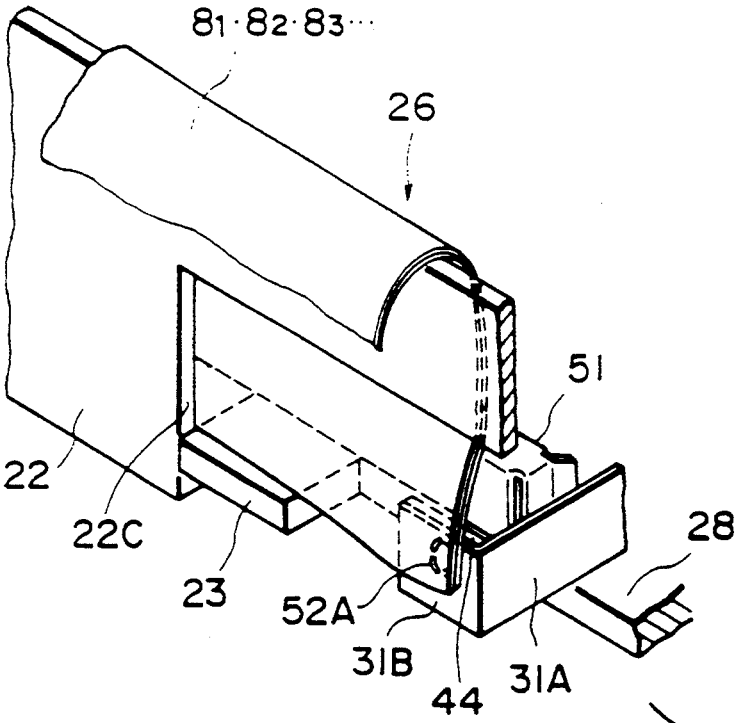
FIG. 8 is a perspective view wherein a retracted state is shown in which the stapled part of the recorded sheets is at an outside of an anvil mounting member.

When the reciprocable arm 38 is retracted, the leading right corner portion of the sheets $8_1$, $8_2$, $8_3$ . . . having been stapled and projected outwardly from the inside of the anvil 44 by the previous advancing movement of the reciprocable arm 38, is returned by its resiliency, but is still placed outside the anvil mounting plate 31B, as shown in FIG. 8. In other words, the stapled set of sheets is placed at a position retracted from the stapling position where the stapling means operates.

Therefore, the corner portions of the sheets having been stapled do not exist at the inside of the anvil 44, so that it is now possible that the next output of the sheets which should constitute a set are stapled.

(5) When one communication outputted from the machine constituted by only one page, the stapling operation is not necessary. In this case, the motor 32 is energized for reverse rotation, by which the pulley 34 and the cam plate 35 are rotated through one full turn in the reverse direction. Therefore, the slider 41 is not advanced, and therefore, the stapling operation is not effected. Rather, only the reciprocable arm 38 reciprocates one time to project the leading right corner portion of the sheet to the outside of the anvil, so that the sheet is retracted from the stapling position.

D. Control of the Stapler

Figure 11:
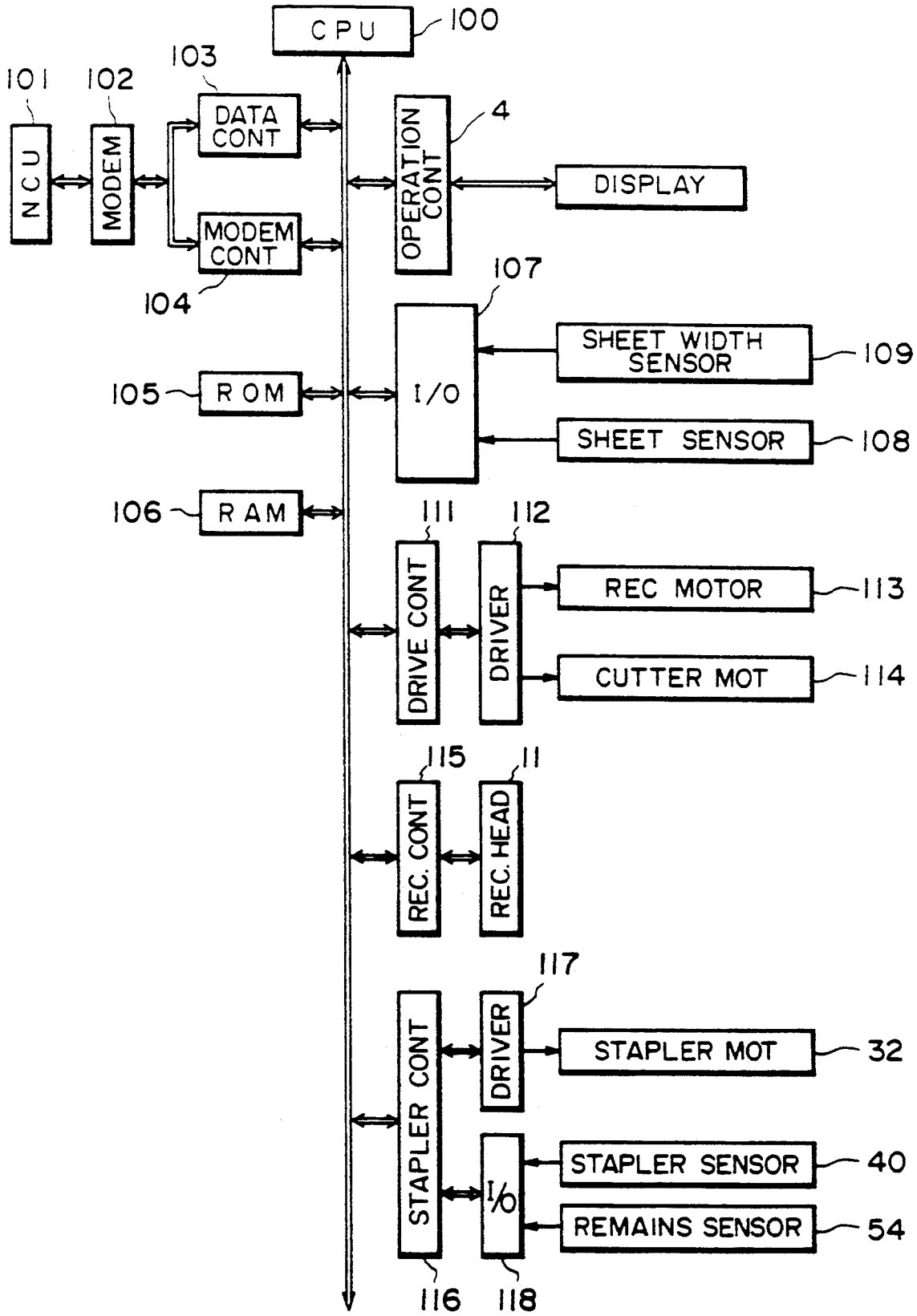
FIG. 11 is a block diagram for the stapler control.

Referring to FIG. 11, there is shown a controlling block diagram for the facsimile machine to control the electric stapler unit 30 described above.

Figure 13B:
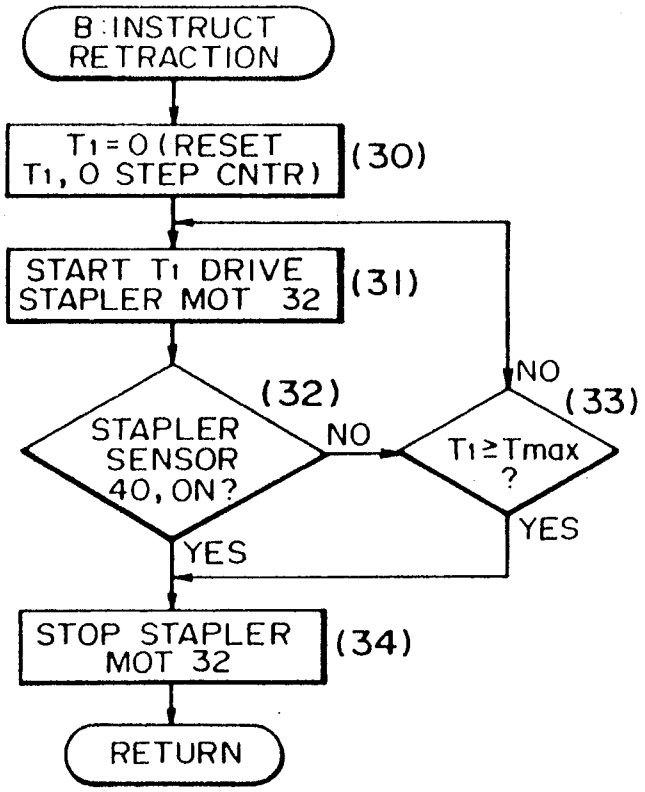
FIGS. 13A and 13B show program stored in a ROM.
Figure 13A:
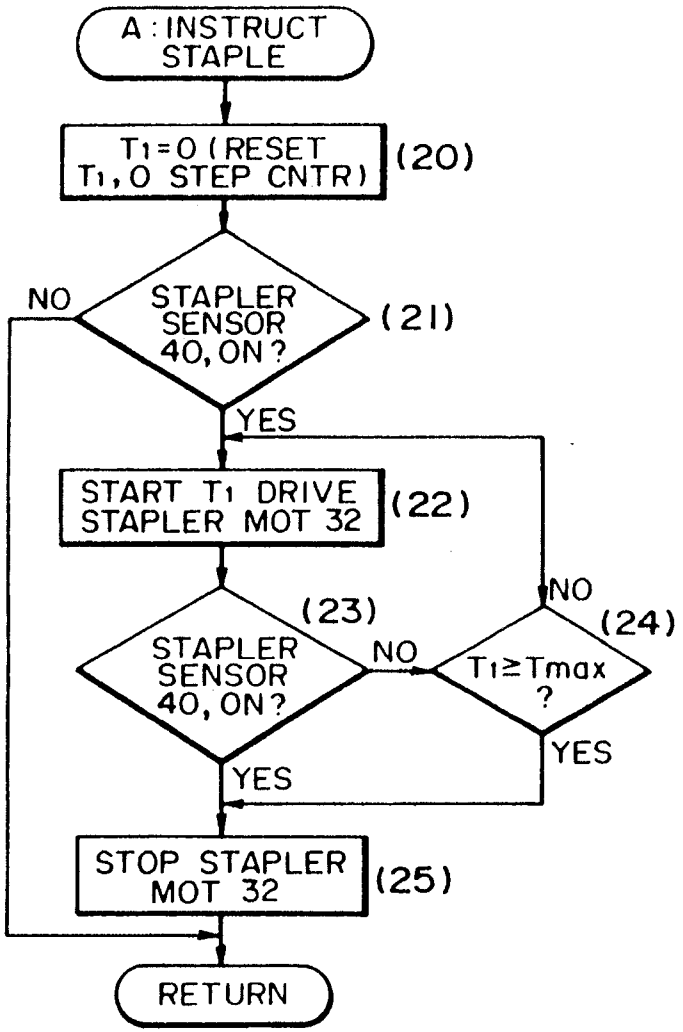

The control system in this example includes a main CPU (central processing unit) 100 for controlling the entire machine (facsimile machine), NCU (network control unit) 101, modem 102, a data controlling section 103, a modem controlling section 104, ROM 105 storing a program which is shown in FIGS. 13A and 13B and which will be described in the following paragraphs (4) and (5), RAM 106 for operation, an operation control section 4 I/O port 107, a drive control section 111, a driver 112, a recording control section 115 and a stapler unit control section 116 for controlling the stapler unit 30.

The operation control section 4 includes an operation panel (control panel) 4 shown in FIG. 1 and is effective to control displays and received instructions from a receiving button.

The I/O port 107 receives signals from the recording sheet sensor 108 for sensing presence and absence of the sheet and a sensor 109 for detecting a width of the recording sheet.

The driver 112 of the drive controlling section 111 is to drive the recording motor 113 and the cutter motor 114.

The driver 117 of the stapler control section 116 drives the stapler motor 32, and the I/O port 118 receives signals from-the stapler sensor 40 and the sensor 54 for detecting the remaining amount of the staples 52 in the staple magazine 51.

Figure 12:
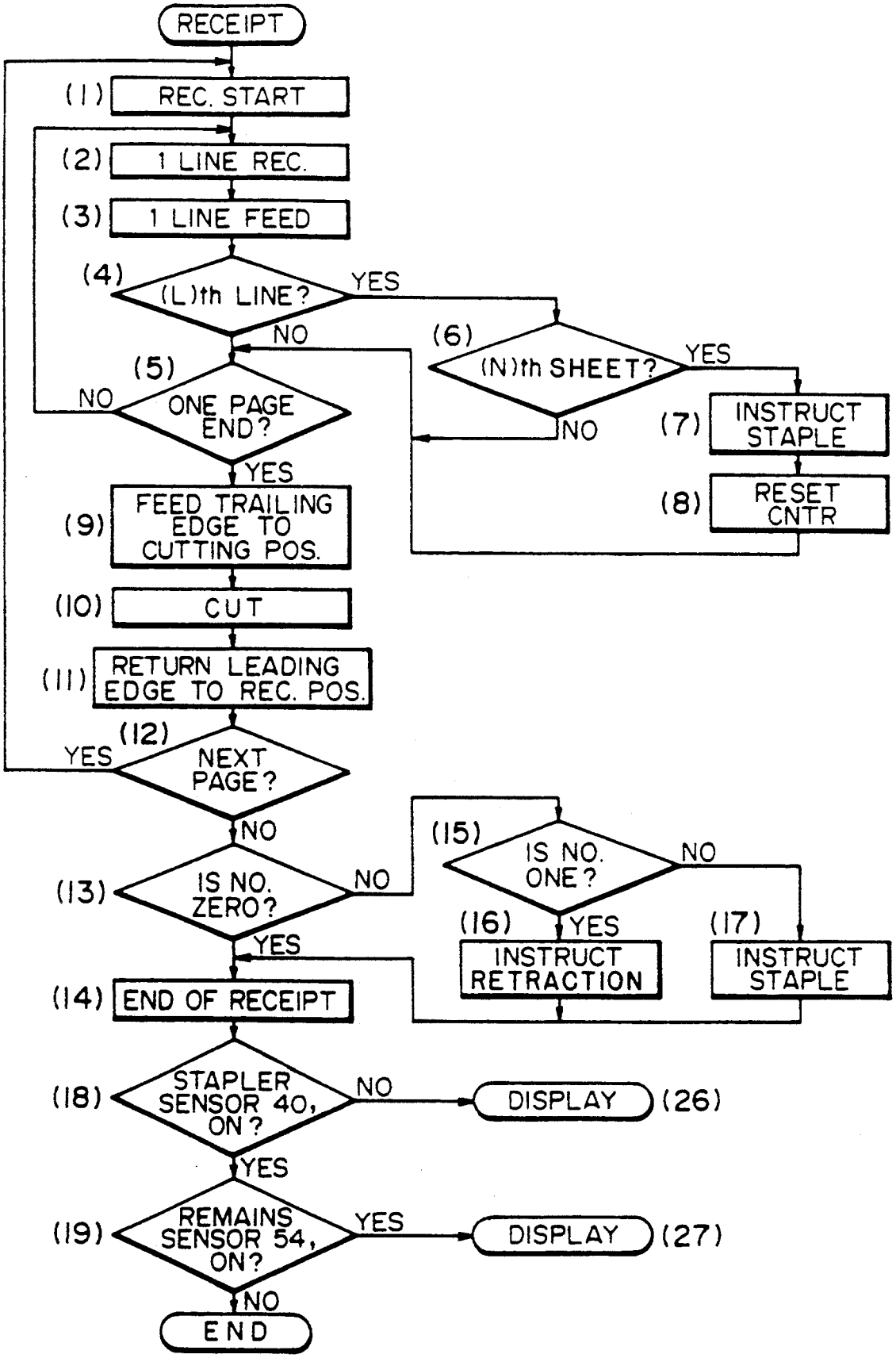
FIG. 12 is a flow chart illustrating the control.

Referring to FIG. 12, the description will be made as to the stapler operation upon receiving information, on the basis of the flow chart of this Figure.

At step 6 in this Figure, "N" is a maximum staplable number of sheets by the stapler unit 30 and can be a predetermined fixed number, or a variable selectable by the user. In an apparatus which is usable with various paper having different thicknesses or paper quality, the number N can be controlled on the basis of detection of the material of the paper. More particularly, the number N is made smaller when the thickness of the paper is large, and the number N is made larger when the paper is thin. In this case, plural numbers N are selectable.

At step 4 of this Figure, "L" is the number of recording lines corresponding to length of the recording sheet which passes from the recording position of the recording head 11 to the stop member 22B plus a slight margin. When the detection is made that the L-th is being recorded ("yes" in step 4), it is detected, in effect, that the leading edge **8*b* of the output part of the paper during the recording reaches the stop member 22B**.

(1) When only one page is discharged (one page per one communication):

The image information received from the sender is transmitted through NCU 101 (FIG. 11) to the modem 102, by which it is demodulated to digital signals, which are in turn transmitted to a data control section 103. The data control section 103 transmit the data through the data bus to the RAM 106, and the data in the RAM 106 is decoded by the CPU 100, and the decoded data is again stored in the RAM 106. In this manner, the RAM 106 stores the data for one line, and then, the data is transmitted to the recording head through the recording control section 115 to effect the recording for one line on the paper 8 (step 2). Upon completion of the one line recording, the CPU 100 drives the recording motor 113 to rotate the plate roller 100 to feed the recording paper 8 by one line (step 3).

The above operation is repeated until the number of recorded lines reaches L ("yes" at step 4), and then, the discrimination is made as to on which page this recording is being made (step 5). However, in this case, only one page is recorded, the above operation is repeated until one page is completed ("yes" at step 5) . Thereafter, the recording paper 8 is slightly fed by the platen roller 10 (step 9) , until the trailing edge reaches the cutter (13 and 14). Then, the cutter motor 114 is actuated so that the recording paper 8 is cut by the cutter blades 13 and 14 (step 10, FIG. 4B). The trailing edge portion of the recorded cut sheet $8_1$ is completely discharged to the outside of the machine through the sheet outlet 27 by the discharging rollers 15 and 16 (chain lines **8*f* in FIG. 4B). On the other hand, the platen roller 11 is slightly reversely rotated after the paper is cut, by which the leading edge of the rolled paper 8 from which the paper $8_1$ is cut out is retracted from the cutter position to the recording position having the recording head 11** (step 11).

Since only one page is to be received in this case ("no" at step 12), the main CPU 100, thereafter, instructs the stapler control section 116 to effect the retracting operation, that is, to rotate the stapler motor 32 in the reverse rotation by one full turn as described in the above paragraph D−(5) (step 16). This is an end of receiving the information (step 14).

(2) The number of discharged sheets is not less than 2 pages and not more than (N−1) pages (a set of plural pages per one communication):

When the receiving operation for the first page is completed in the manner described in the above paragraph (1), the operation should be performed for the next page ("yes" at step 12). Therefore, the sequence goes back to the step 1 to start the next page recording. The steps 1–5, and 9–12 are repeated until all the pages are recorded ("no" at step 12). Then, since the number of the output sheets is not less than 2 ("no" at step 15), the main CPU 100 instructs the stapler control section 116 to effect the stapling operation (step 17), and this is the end of receiving the information (step 14). The stapling operation, that is, the operation described in the above paragraphs D-(1), (2), (3) and (4), is carried out for the plural recorded sheets, and then, the stapled part of the sheets is released from the stapling position.

(3) When the number of discharged sheets is not less than N:

The recording operation is carried out in the same manner as described in the above paragraph (2) up to (N-1)th page. When the number of recorded line reaches L on the N-th ("yes" at step 4), it is detected that the recording is effected on the N-th page ("yes" at step 6), and the main CPU 100 instructs the stapler control section 116 to effect the stapling operation (step 7). Also, a counter for counting a number of received sheets is reset (step 8), and the recording operation is repeated. At this time, the recording operation and the stapling operation are carried out simultaneously.

Thus, the main CPU 100 instructs the stapling operation of the stapler control section 166 for every N pages (step 7).

If there is no next page ("no" at step 12), the counter is checked, and if it is zero ("yes" at step 13), the information receiving operation terminates (step 14). Otherwise, the steps described in the above paragraph (1) or (2) are executed, and the information receiving operation is terminated. In other words, when the total number of pages received is expressed by $x=n\times N+\underline{a}$ (n is integer, (0, 1, 2 . . . )), the information receiving operation is terminated as it is if $\underline{a}=0$; only the retracting operation is performed as described in the above paragraph (1), only the retracting operation is performed, if $\underline{a}=1$; the information receiving operation is terminated after the stapling operation is effected as stated in the above paragraph (2), if $\underline{a}$ is not less than 2 and not more than (N−1).

As described in the foregoing, since when the leading edge of the N-th output sheet abuts to the stop member 22B, the stapling operation is performed together with the recording operation, the communication period is reduced, and the possibility of the error occurrence due to over time receiving, as compared with the stapling operation performed between one communication and the next communication.

(4) Detailed description of the stapling operation:

FIG. 13A shows a flow chart of a stapler control section for controlling the stapling operation at the steps 7 and 17 in the flow chart of FIG. 12.

Upon receipt of the stapling operation instructions, the stapler control section first reset (step 20) a step counter T1 for detecting stapler jam. Next, if the stapler sensor 40 is not "on" ("no" at step 21), it is deemed that a stapler jam (the stapler mechanism is not returned to stand-by position shown in FIG. 5 for one reason or another) has occurred in the previous stapling operation, and therefore, the stapler does not operate. If the stapler sensor 40 is "on" ("yes" at step 21), the step counter T1 starts, and the stapler motor 32 is rotated forwardly (step 22).

In step 24, "Tmax" is a number of motor steps for the one full rotation of the pulley 34 and the cam 35 plus a small margin. The stapler motor 31 is driven in the forward direction until the stapler sensor 40 becomes on (step 23), or until the step counter T1 counts Tmax (step 24), and thereafter, it is stopped (step 25). By this, the stapling operation is terminated.

If, in the above operation, the stapler sensor 40 is actuated earlier, it is deemed that the stapling operation is performed in good order. However, if on the contrary, the step counter T1 reaches Tmax earlier, it is deemed that the stapler jam occurred. The result is stored in the stapler sensor 40, and therefore, the properness of the stapler operation can be judged by the main CPU 100 checking the output of the stapler sensor 40 after the completion of the information receiving operation.

(5) Detailed description of the retracting operation:

FIG. 13B is a flow chart for a stapler control section of the retracting operation at the step 16 in the flow chart of FIG. 12.

Upon reception of the instructions for the retracting operation from the main CPU 100, the stapler control section reset the step counter T1 for detecting the stapler jam (step 30). Next, the step counter T1 starts, by which the stapler motor 32 is rotated in the reverse direction. The reverse rotation of the stapler motor 32 continues until the stapler sensor 40 is actuated (step 32), or until the step counter T1 counts Tmax (step 33). Thereafter, it is stopped (step 34) to terminate the retracting operation.

In the above operation, if the stapler sensor 40 is actuated earlier, the retracting operation is deemed as having been completed in good order. However, if the step counter T1 counts Tmax earlier, the retracting operation is deemed as having been in trouble. The result is stored in the stapler sensor 40, and therefore, the properness of the retracting operation can be discriminated by the main CPU 100 checking the output of the stapler sensor 40 after the completion of the information receiving operation.

(6) Jam clearance for the stapler:

If the stapler sensor 40 is not "on" after the completion of the information receiving operation, the main CPU 100 deems that the stapler is jammed ("no" at step 18 of the flow chart of FIG. 12), and instructs the display on the operation panel 4 to display "inspect stapler" or the lake (step 26).

Figure 14:
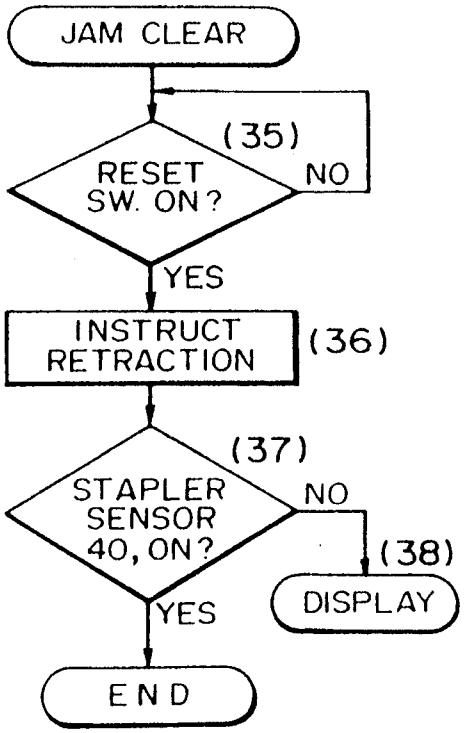
FIG. 14 is a flow chart illustrating a stapler jam clearance operation.

In response to the display, the operator takes the staple magazine 51 from the magazine mount 50, and remove the jammed staple. Thereafter, the operator mounts the staple magazine 51 into the mount 50, and depresses an unshown reset button on the operation panel 4. The flow chart therefor is shown in FIG. 14. In response to the depression of the reset button (step 35), the main CPU 100 instructs the retracting operation to the stapler control section 116 (Step 36). If the stapler sensor 40 becomes "on" after the completion of the retracting operation, it is deemed that the stapler is now back in order, but if not, "inspect stapler" or the like is displayed again (step 37=step 26 of FIG. 12) to request the reinspection of the operator.

(7) Staple supply:

When the number of staples 52 in the staple magazine 51 becomes smaller than a predetermined or becomes zero, it is detected by the sensor 54 as described hereinbefore in conjunction with FIG. 10. (step 19 in FIG. 12), the shortage or empty is displayed on the operation panel 4 by the main CPU=100 (step 27). Even if the empty is detected during the information receiving operation, the information receiving and recording sheet discharging operations are continued, and the display is made during or after the receiving operation.

The operator then takes the staple magazine 51 out of the mount 50, and replenish the magazine 51 with the staples 52, and the magazine 51 is set again into the mount 50.

F. Others (1) The sheet binding means may be in the form of the stapling means described above, by it may be paste applying means, revering means, a means for binding the sheets by partly shearing the sheets by pressing blade.

(2) The means for retracting, pushing or displacing from the operating position of the binding means the sheets having been bound by the binding means or the sheet not necessary to be bound (one page per one communication) for the purpose of the binding process for the next sheets may be in the form of, in addition to the pushing system for pushing it or them out of the stapling position by the reciprocable arm 38 as described hereinbefore, the following:

a. A sheet discharging means such as discharging roller or the like is provided to discharge from the cavity 26 functioning as a recording sheet stacker to an external box or the like the stapled sheets or the sheet unnecessary to be bound.

b. Means for automatically opening and closing the holder plate 22 is provided to open the holder plate 22 to allow the stapled sheets or the sheet not to be stapled to fail from the cavity 26 into an external box.

c. Means is provided to displace the sheets held in the cavity 26 away from the operating position of the binding means, so as to retract the sheet or sheet from the binding means operating position.

(3) As for the case where the number of the discharged sheets is not less than N, the stapling operation is simply prohibited. And, when the leading edge of the last one of the N or more sheets reaches the stop member 22B, the retracting means is actuated to retract the sheets out of the binding means operating position.

(4) When the machine is usable with two or more kinds of paper for output sheets having different widths, means may be provided for detecting the width of the sheet in use, and means may be provided to displace the binding means to a position corresponding to the detected width.

(5) When the machine is usable with two or more kinds of paper as the recording paper having different widths, the sheets is discharged with its one lateral side aligned with a common reference, and the binding means is disposed at a fixed position adjacent to the reference side.

As described according to this embodiment:

(1) The sheet material binding means (stapler) is mounted on a frame of the machine which is strong and rigid, by which the vibration, noise or the like of the sheet material discharging machine can be remarkably reduced upon the binding operation, and the stabilized binding operation can be assured.

(2) The output sheets corresponding to plural communications having sender or having different pages, are sequentially overlaid, the sorting thereafter is easy without low possibility of error. This is because the output sheets which should constitute one set for one communication are bound for each of the sets if the total number of the sheet in the set is not less than 2 and less than N; and if the number is larger than N for which it is difficult or not possible to bind all at once, the sheets are bound for each N sheets as divided sets of sheets; and if the number of rest sheets is not less than 2, they are bound as an additional divided set.

(3) During the process of the last one of the sheets which should constitute one set of sheets being discharged, the binding means is operated after the edge thereof to be abutted to a stopper member reaches the stopper member and is aligned thereto, without waiting for the trailing edge of the sheet material to be completely discharged. Still, the sheet binding operation is executed or all the sheets which constitutes one set of sheets, including the last sheet being discharged. Taking a facsimile machine, for example, the communication period can be reduced, and the possibility of error occurrence due to overtime can be reduced, as compared with the case where the binding means is operated after the trailing edge of the last sheet is completely discharged.

(4) The sheet discharging operation is continued, even if the detecting means detects that the sheet material binding means becomes short of the binder material or become empty. Therefore, taking a facsimile machine, for example, the information receiving operation is continued so that the communication is not obstructed, even if there becomes no binder materials such as a staple, although the discharged sheets thereafter are not bound.

Even if the detecting means detects that the amount of the remaining binder materials becomes smaller than the predetermined, the binding means is maintained operable, and therefore, the sheet binding operation is performed until it becomes completely empty.

(5) Even if the sheet material binding means becomes unresettable (jam of binding means) during operation of the machine, the sheet discharging operation is continued. Therefore, taking a facsimile machine, for example, if the sheet material binding means such as a stapler is jammed, the information receiving and sheet discharging operations are performed, and therefore, the communication is not obstructed, although the plural sheets to constitute one set of sheets are not bound.

Figure 15:
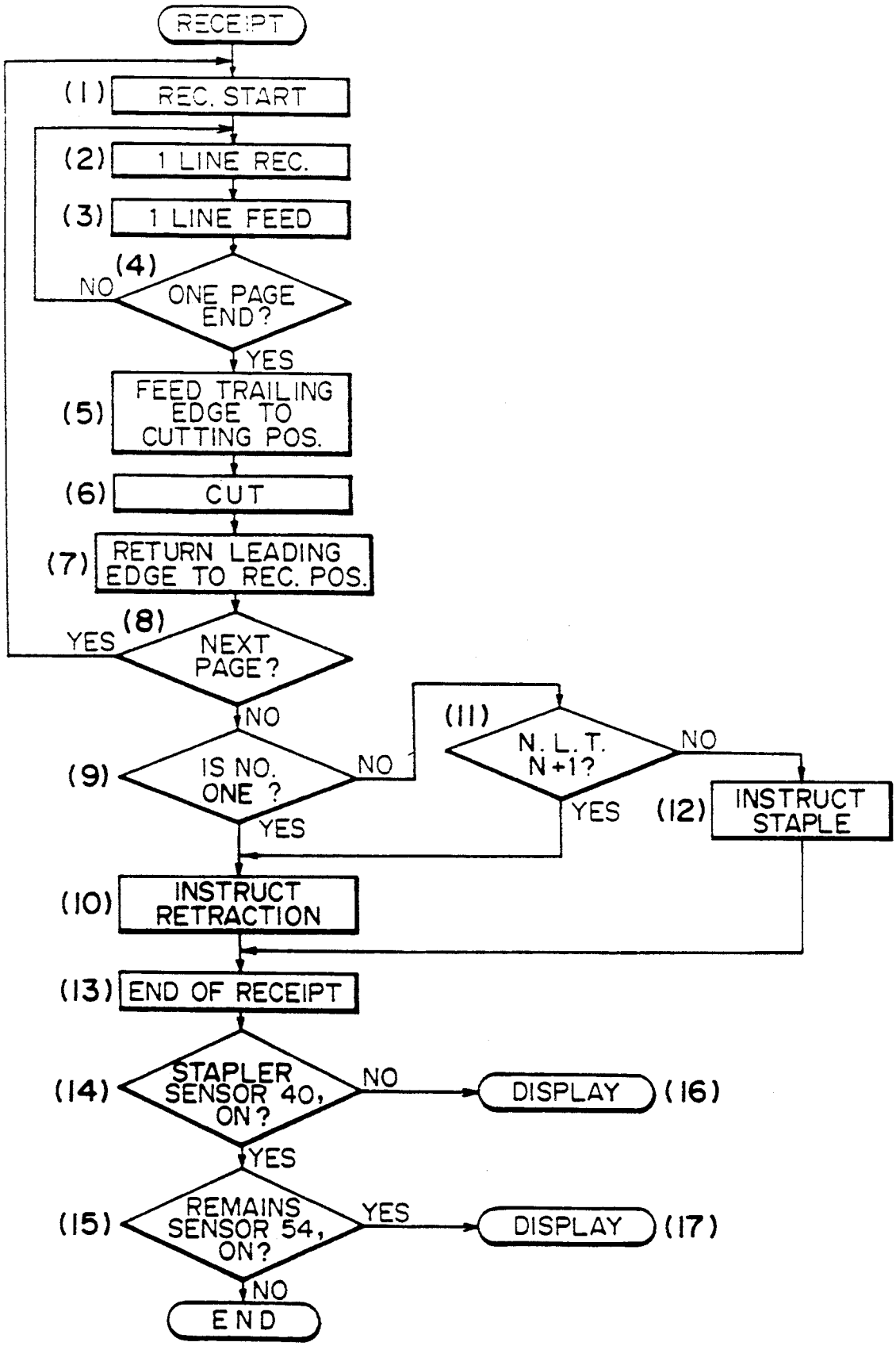
FIG. 15 is a flow chart according to another embodiment.

Referring to FIG. 15, the description will be made with respect to a stapler operation (stapling operation) at the time of information receiving operation according to another embodiment of the present invention.

At step 11 in this Figure, "N" is a maximum staplable number of sheets by the stapler unit 30 and can be a predetermined fixed number, or a variable selectable by the user. In an apparatus which is usable with various paper having different thicknesses or paper quality, the number N can be controlled on the basis of detection of the material of the paper. More particularly, the number N is made smaller when the thickness of the paper is large, and the number N is made larger when the paper is thin. In this case, plural numbers N are selectable.

(1) When only one page is discharged (one page per one communication):

The image information received from the sender is transmitted through NCU 101 (FIG. 11) to the modem 102, by which it is demodulated to digital signals, which are in turn transmitted to a data control section. 103. The data control section 103 transmit the data through the data bus to the RAM 106, and the data in the RAM 106 is decoded by the CPU 100, and the decoded data is again stored in the RAM 106. In this manner, the RAM 106 stores the data for one line, and then, the data is transmitted to the recording head through the recording control section 115 to effect the recording for one line on the paper 8 (step 2). Upon completion of the one line recording, the CPU 100 drives the recording motor 113 to rotate the plate roller 100 to feed the recording paper 8 by one line (step 3).

The above operation is repeated for one entire page ("yes" at step 4), and then, the recording paper 8 is slightly fed by the platen roller 10 (step 5) , until the trailing edge reaches the cutter (13 and 14) . Then, the cutter motor 114 is actuated so that the recording paper 8 is cut by the cutter blades 13 and 14 (step 6, FIG. 4B). The trailing edge portion of the recorded cut sheet $8_1$ is completely discharged to the outside of the machine through the sheet outlet 27 by the discharging rollers 15 and 16 (chain lines 8*f* in FIG. 4B). The platen roller 10 is slightly reversely rotated after the paper is cut, by which the leading edge of the rolled paper 8 from which the paper $8_1$ is cut out is retracted from the cutter position to the recording position having the recording head 11 step 7).

Since only one page is to be received in this case ("no" at step 8, "yes" at page 9), the main CPU 100, thereafter, instructs the stapler control section 116 to effect the retracting operation, that is, to rotate the stapler motor 32 in the reverse rotation by one full turn (step 10). This is an end of receiving the information (step 13).

(2) The number of discharged sheets is not less than 2 pages and not more than (N−1) pages (a set of plural pages per one communication):

When the receiving operation for the first page is completed in the manner described in the above paragraph (1), the operation should be performed for the next page ("yes" at step 8). Therefore, the sequence goes back to the step 1 to start the next page recording. The steps 1–8 are repeated until all the pages are recorded ("no" at step 12). Then, since the number of the output sheets is not less than 2 and not more than "N" ("no" at step 9, and "no" at step 11), the main CPU 100 instructs the stapler control section 116 to effect the stapling operation (step 12), and this is the end of receiving the information (step 13) The stapling operation, that is, the operation is carried out for the plural recorded sheets which should constitute one set, and then, the stapled part of the sheets is released from the stapling position.

(3) When the number of the output sheets is not less than N+1:

In this case, the operations similar to those described above are executed until there is no next page ("no" at step 8). Thereafter, since the number of recorded sheets is not less than (N+1) ( "no" at step 9, "yes" at step 11), the main CPU 100 instructs the stapler control section 116 to execute the retracting operation (step 10). Therefore, the plurality of sheets which should constitute a set of (N+1) sheets are not stapled, but is retracted or pushed out of the stapling position. Then, the information receiving operation terminates (step 13).

In FIG. 15 the predetermined number N corresponds to a maximum bindable number of the sheets which can be properly stapled by the binding means. If the binding means is a stapler, for example, the number is determined as a largest possible number which can be stapled at once in consideration of the length of the legs of the used staples and the thicknesses of the output sheets.

Taking a facsimile machine as an example of the sheet material discharging machine, even if plural sets of communications are sent from different senders and they contain different numbers of pages, the sets of sheets which should constitute respective sets of sheets (plural sheets per one communication) can be bound for each of th sets, if the number of sheets in a set is not less than 2 and not more than N. Although the set of the number of sheets which is not less than N for which it is difficult or not possible to bind them all at once, are not bound, but those sheets can be easily distinguished from the other bound sets of sheet so that the later sorting is easy without error.

Figure 16:
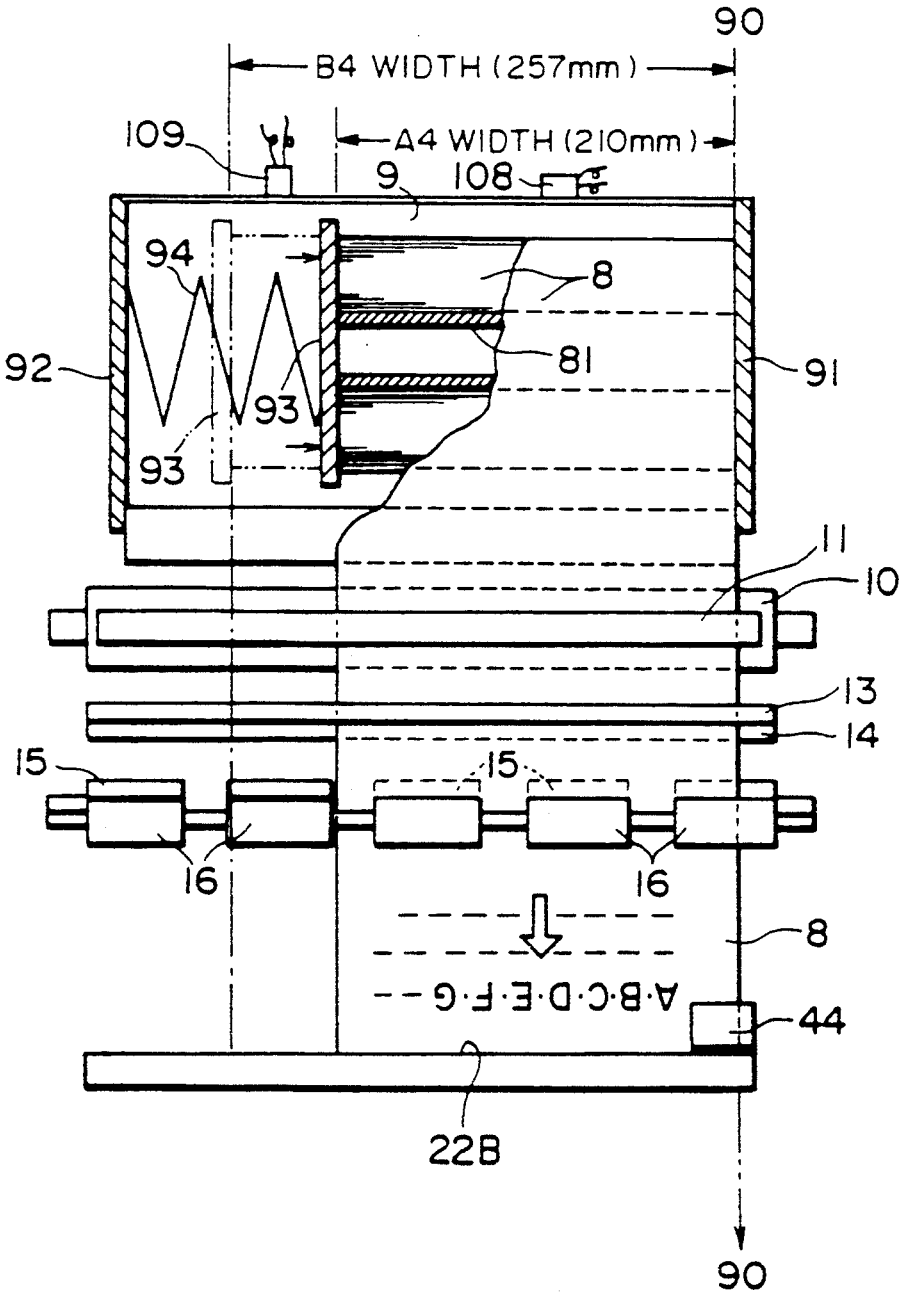
FIG. 16 is a partly broken developed plan view illustrating an example of sheet transportation with one lateral edge regulated.

Referring to FIG. 16, the machine wherein the sheets are discharged in a side edge alignment system. In this Figure, the same reference numerals as in FIGS. 1–3 are assigned to the elements having corresponding functions, and detailed descriptions thereof are omitted for simplicity.

The roll paper 8 is wound on a core 81. The rolled recording paper 8 is contained in a paper container 9 in the form of a trough opening upwardly. The container 9 includes fixed side plates 91 and 92 for enclosing the longitudinal ends. The container further includes a movable side plate in the container 9, which is slidably movable along the longitudinal direction of the container keeping the parallelism with the fixed side plate 91. The movable side plate 93 is normally urged rightwardly in this Figure by a spring member 94 compressed between the movable side plate 93 and the fixed side plate 92.

Rolled paper 8 having different widths such as A4 size and B4 size is usable. In either case, when the roll of the recording paper 8 is to be accommodated in the container 9, the movable side plate 93 is pushed leftwardly against the spring force by the spring member 94 to expand the space with the right fixed side plate 91, and then the rolled paper 8 is placed in the container. Subsequently, the movable side plate 93 is released to allow the rolled paper 8 to be sandwiched between the right fixed side plate 91 and the opposite movable plate 93. In FIG. 16, the solid lines indicate the rolled paper 8 having a size of A4 accommodated therein, and the chain lines indicate the rolled recording paper 8 having a size of B4 contained therein.

The rolled recording paper 8 which has been contained in the container 9 and sandwiched between the right fixed side plate 91 and the movable side plate 93 in this manner, is prevented from the rightward and leftward movement, but is rotatable for unwinding. Therefore, even if the width of the rolled recording paper 8 used with the machine is different, such as A4 width and B4 width, the right fixed side plate 91 functions as a reference irrespective of the width of the paper, and therefore, the paper is unwound with its one side aligned to an extension 90—90 of the inside surface of the side plate 91.

A sensor 108 (a reflection type photosensor, for example) detects whether or not the rolled recording paper 8 is contained in the container 9, and a sensor 109 (a reflection type photosensor, for example) detects in which range the width of the used rolled paper contained in the container falls. In the example shown in FIG. 16, the former sensor 108 detects the rolled recording paper 8, but the latter sensor 109 does not detect the paper, and in this case, the control circuit discriminates that the size of the paper 8 contained in the container is A4 width. If the former sensor detects the paper, and also the latter sensor 109 detects (on), the size of the paper contained has the B4 width. The control circuit discriminates so.

After the rolled recording paper 8 is set in the container 9 in the manner described above, the leading edge of the roller recording paper is slightly unwound and is placed on the platen roller 10, and then the top cover 2 is closed. When the top cover 2 is closed sufficiently, the locking means operates to maintain it in the closed state, as shown in FIG. 3 by solid lines. By this, the surfaces of heat generating elements of the heat generating element array assembly (recording head) 11 functioning as the recording means disposed on an inside of the top cover, is press contacted to the top surface of the platen roller 10 with the recording sheet 8 interposed therebetween.

The operation will be described.

(1) Upon record starting signal for the image information to be received, the platen roller 10 is intermittently rotationally driven one line by one line. The paper feeding rollers 15 and 16 are driven in the directions indicated by arrows at a predetermined peripheral speed. The friction rollers 18 and 18 are rotated in the directions indicated by arrows in response to the rotation of the roller 15.

The leading edge portions of the thermosensitive recording paper 8 in the form of a roll is interposed between the top surface of the platen roller 10 and the recording head 11, so that it is pulled by the intermittent rotation of the platen roller 10 one line by one line. By the pulling force, the rolled paper in the container 9 rotates in the unwinding direction, and the rolled recording paper is unwound with its one side alinged to an extension 90—90 (FIG. 16) of an inside surface of the right fixed side plate 90 of the container, as described above.

On the other hand, the base plate 31 of the stapler unit 30 is securedly fixed on the top surface of the machine base 28 so that the inside of the anvil 44 is placed at an outside position corresponding to the leading right corner portion of the recorded paper $8_1$, $8_2$, $8_3$. . . abutted to the bottom surface 22B (stopper member) in the cavity 26, that is, at the position adjacent to the reference 90—90 side of the above described FIG. 14 adjacent the bottom surface 22B, and so that the staple magazine 51 mounted to the mount 50 is extended at the inside of and parallel with the front wall 17 of the machine.

By the stapler unit 30, the output or discharged recorded sheets $8_1$, $8_2$, $8_3$. . . which should constitute a set of sheets, are stapled at an upper left corner in the recorded sheets.

As described in the foregoing, according to this embodiment, the discharged sheets are discharged with its one side aligned to a common one side reference line irrespective to the width of the sheets, and the sheet binding means is disposed adjacent to the one side reference line and adjacent to the sheet stopper member for aligning the discharged sheets by regulating at least one edge of the sheets sequentially discharged. Therefore, irrespective of the width of the discharged sheets, those corners of the discharged sheets aligned by the sheet stopper member and the reference, is opposed to the sheet binding means. Accordingly, the binding operation for the plural sheets which should constitute a set are executed without trouble irrespective of the width of the discharged sheet.

Referring to FIGS. 17–21, the structure will be described wherein the sheets are fed in a center line alignment system according to another embodiment of the present invention. In those Figures, the same reference numerals as in FIGS. 1—3 are assigned to the elements having corresponding functions, and the detailed description thereof is omitted for simplicity.

The rolled recording paper 8 is contained in a container 9 in the form of a trough opening upwardly. The container 9 includes fixed side plates 191 and 192 for closing the longitudinal ends. The container 9 also includes a couple of movable side plates 193 and 194. The movable side plates 193 and 194 are disposed equidistantly from a central axis 190—190. Those movable side plates are associated in structure that when one of them, for example, the left movable side plates 193 is slid leftwardly or rightwardly in the container 9, the other movable side plate 94 slid in the opposite direction, keeping the center therebetween coincide with the axis 190—190 and changing the interval therebetween. Between the left fixed side plate 191 and the left movable side plate 193, and between the right fixed side plate 192 and the right movable side plate 194 compression springs 195 and 196 are disposed, respectively, so that the left and right movable side plates 193 and 194 are normally urged in the direction reducing the interval therebetween. One of the springs 195 and 196 may be omitted.

Figure 18:
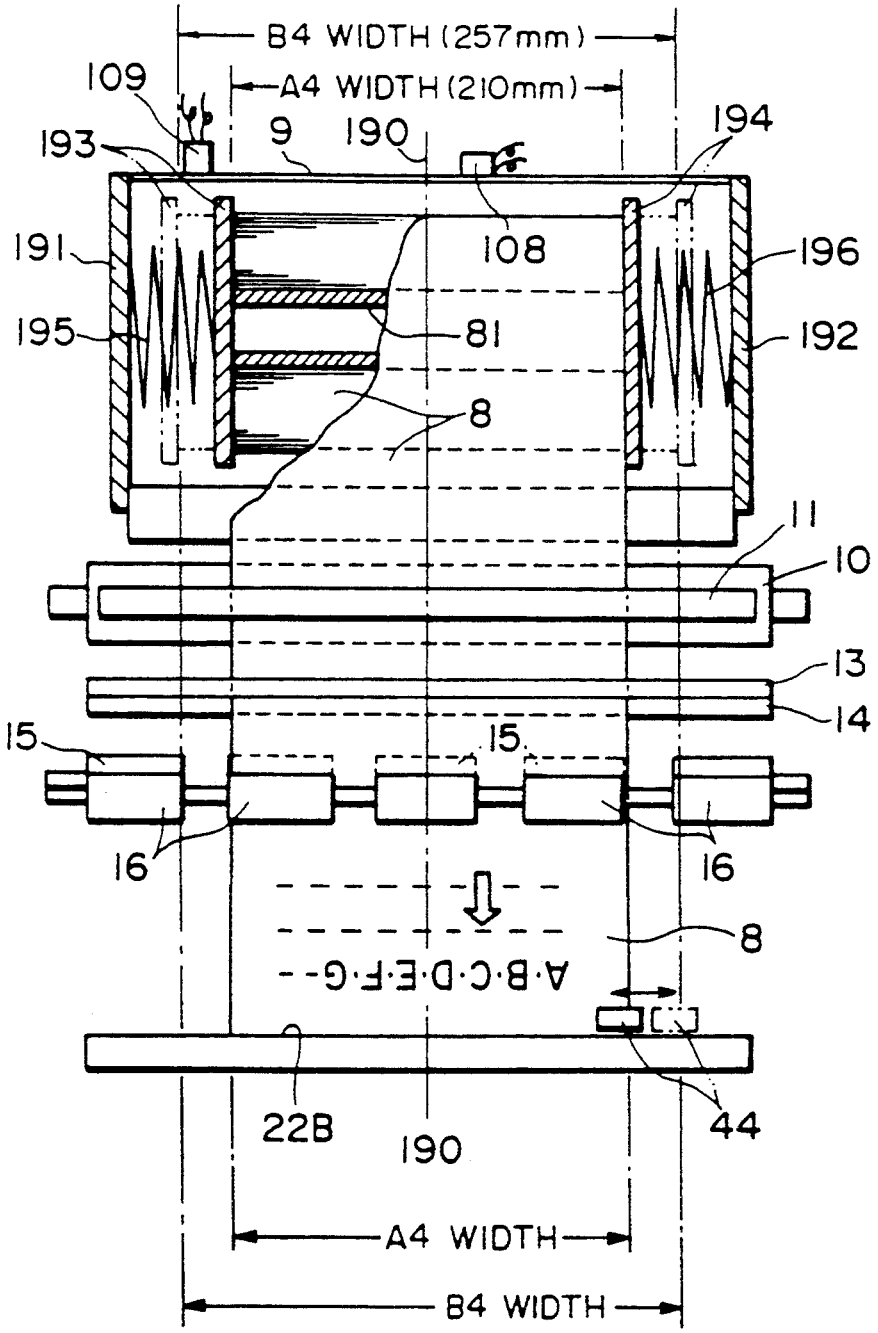
FIG. 18 is a partly broken developed plan view thereof.

The machine is usable with rolled recording paper 8 having a different width such as A4 width or B4 width. In either case, when the recording paper 8 is to be set into the container, one of the movable side plates is slid away from the other movable side plate against springs 195 and 196 to expand the interval between the movable side plates 193 and 194, and the rolled recording sheet 8 is placed in the container. Then, the movable side plate is released, so that the rolled recording sheet 8 is sandwiched by the left and right movable plates 193 and 194. The solid lines in FIG. 18 show the rolled recording paper 8 having A4 width set in the container, and the chain lines show the rolled recording paper 8 having B4 width set in the container 9.

The rolled recording paper 8 sandwiched between the left and right movable plates 193 and 194 in the container 9 is prevented from movement in the leftward or rightward movement, but is freely rotatable to allow unwinding.

Therefore, the rolled recording paper 8 set in the container 9, irrespective of the width thereof, is unwound with its center aligned with a reference center line of the container 9.

The operation will be described.

The thermosensitive recording paper 8 in the form of a roll is sandwiched between the top surface of the platen roller 10 and the recording head 11 at its leading edge. When the platen roller 10 is intermittently driven one line by one line, a pulling force is applied thereto. By this force, the rolled recording paper rotates in the unwinding direction in the container 9, and the rolled paper is unwound with its center line aligned with a reference center line 190—190 (FIG. 18) of the container 9. During the unwound part of the paper being intermittently fed one line by one line through the recording station, that is, between the platen roller 10 and the recording head 11, the heat generating elements of the recording head 11 are controlled in the heat generation in accordance with time series electric picture element signals corresponding to the image information received from the sender, by which image information corresponding to the received image information is recorded on the top surface of the unwound part of the paper one line by one line.

The description will be made with respect to movement of the stapler in accordance with the size of the sheet.

Figure 17:
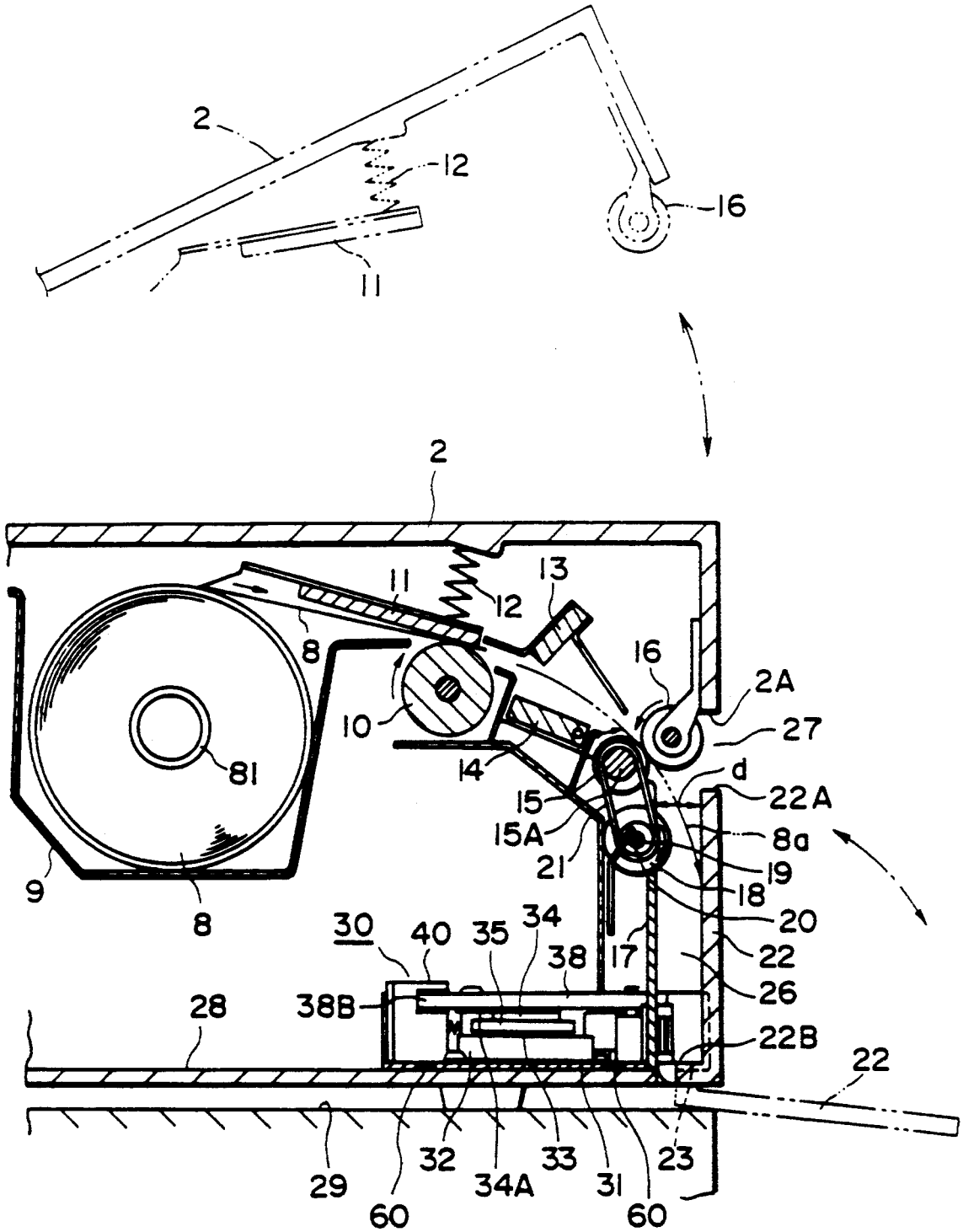
FIG. 17 is an enlarged cross sectional view of recording and sheet discharging mechanisms in a sheet transportation with its center alinged with a reference.
Figure 19:
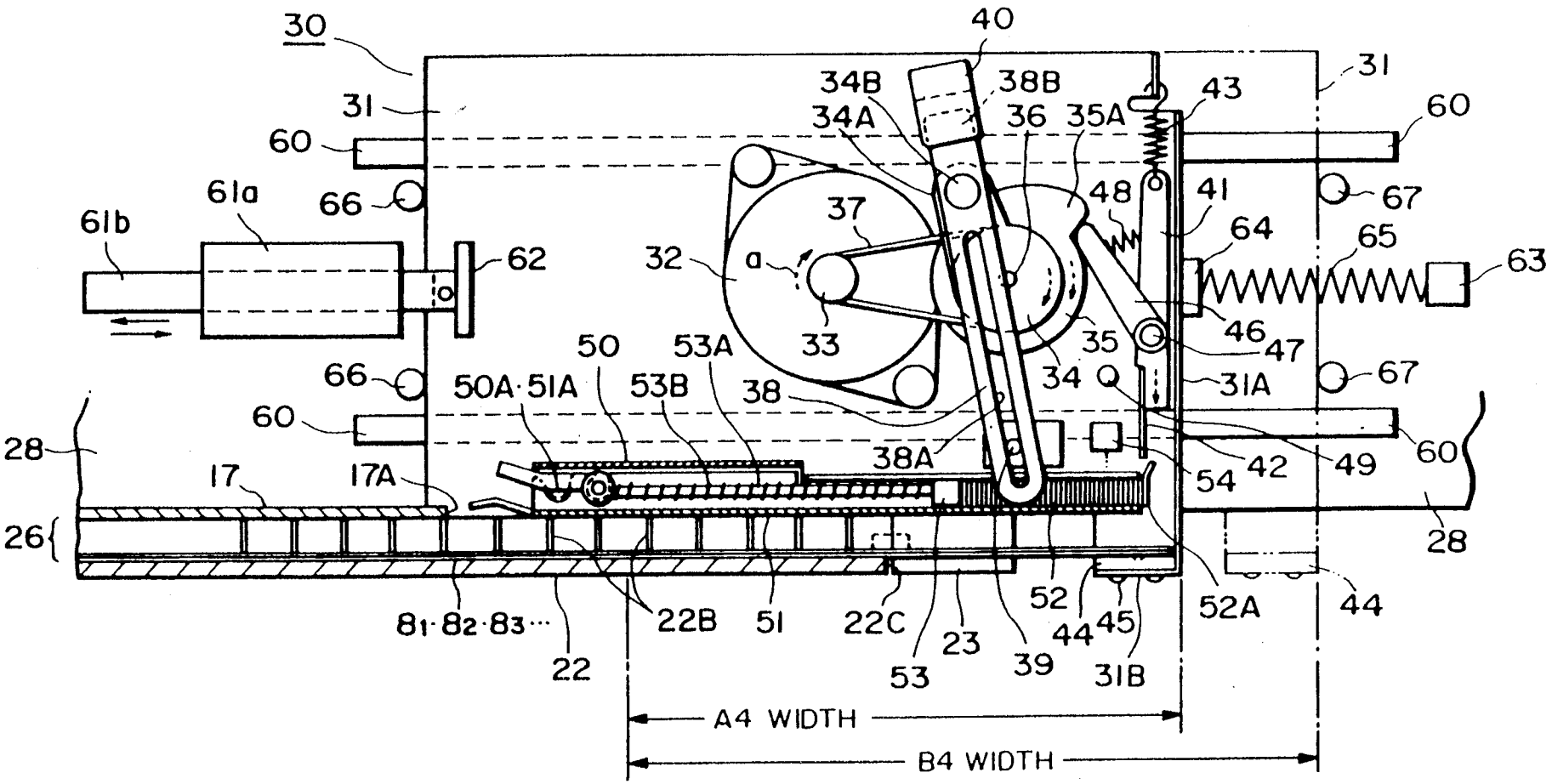
FIGS. 19, 20 and 21 are enlarged plan view illustrating operational process of the stapler unit.

FIG. 17 is an enlarged top plan view partly broken of an electric stapler unit. The stapler unit 30 includes a base plate 31. The base plate 31 is mounted on the top surface of the machine base 28 for smooth sliding movement along guide rails 60 and 60 in the left-right directions without rattle. As shown in FIG. 19, it comprises electromagnetic solenoid plunger 61*a* and 61*b*. The solenoid 61*a* is fixed on the top surface of the machine base 28 at a left side of the base plate 31, and the right end of the plunger 61*b* is connected with a lug 62 planted in the base plate 31. A lug is planted fixedly on the top surface of the machine base 28 at a right side of the base plate 31, and a tension spring 65 is stretched between the lug 63 and the lug 64 of the base plate 31.

When the solenoid 61*a* is energized, the base plate 31 is moved by the leftward driving force of the plunger 61*b* against the tension spring 65 to be abutted to the left stopper pins 66 and 66, where it is stopped, at shown in FIG. 19. As long as the solenoid 61*a* is energized, the position is maintained. This position will be called "first position".

When the solenoid 61*a* is deenergized, the plunger 61*b* becomes freely rotatable, so that the tension force of the tension spring 65 of the base plate 31 moves it rightwardly to abut it to the right stopper pins 67 and 67, as shown by chain lines in FIG. 19. As long as the solenoid 61*a* is deenergized, it is maintained at this position. Hereinafter, this position will be called "second position".

As will be understood, the base plate 31 is movable between the first position and the second position by energizing or deenergizing the solenoid 61*a*.

The stapler unit 30 is so disposed that the inside of the anvil-44 opposed to leading edge right corner of the discharged recorded sheets $8_1$, $8_2$, $8_3$. . . received by the cavity 26 with their leading edge abutted to the bottom surface 22*b* functioning as a stopper member, and that the staple magazine 51 mounted to the mount 50 extends substantially parallel with the front wall 17 at the inside thereof. And, as described above, the base plate 31 of the stapler unit 30 is mounted on the top surface of the machine base 28 for sliding movement in the left-right direction between the first position and the second position.

The description will be made with respect to the control of the position of the stapler unit 30.

When the rolled recording paper 8 having an A4 width or B4 width is set in the container 9 in the machine, and the top cover 2 is closed, the sensors 108 and 109 detect presence of the recording sheet 8 in the machine, and the outputs thereof are transmitted to the control circuit, which discriminates whether the set paper 8 has the A4 width or B4 width. If it is A4 width, the solenoid 61*a* is deenergized, so that the base plate 31, and therefore, the stapler unit 30 is maintained at, or moved to and then maintained at the first position. In this position, the anvil 44 of the stapler unit 30, as shown in FIGS. 18 and 19 by solid lines, is moved to an outside position corresponding to the leading edge right corners of the discharged recording paper (received sheet) $8_1$, $8_2$, $8_3$ . . . having A4 width received in the cavity 26 functioning as a stacker portion with their edges abutted to the bottom surface 22*b* functioning as the stopper member, so that the stapling operation is possible to the upper left portion of the recorded sheet.

Figure 20:
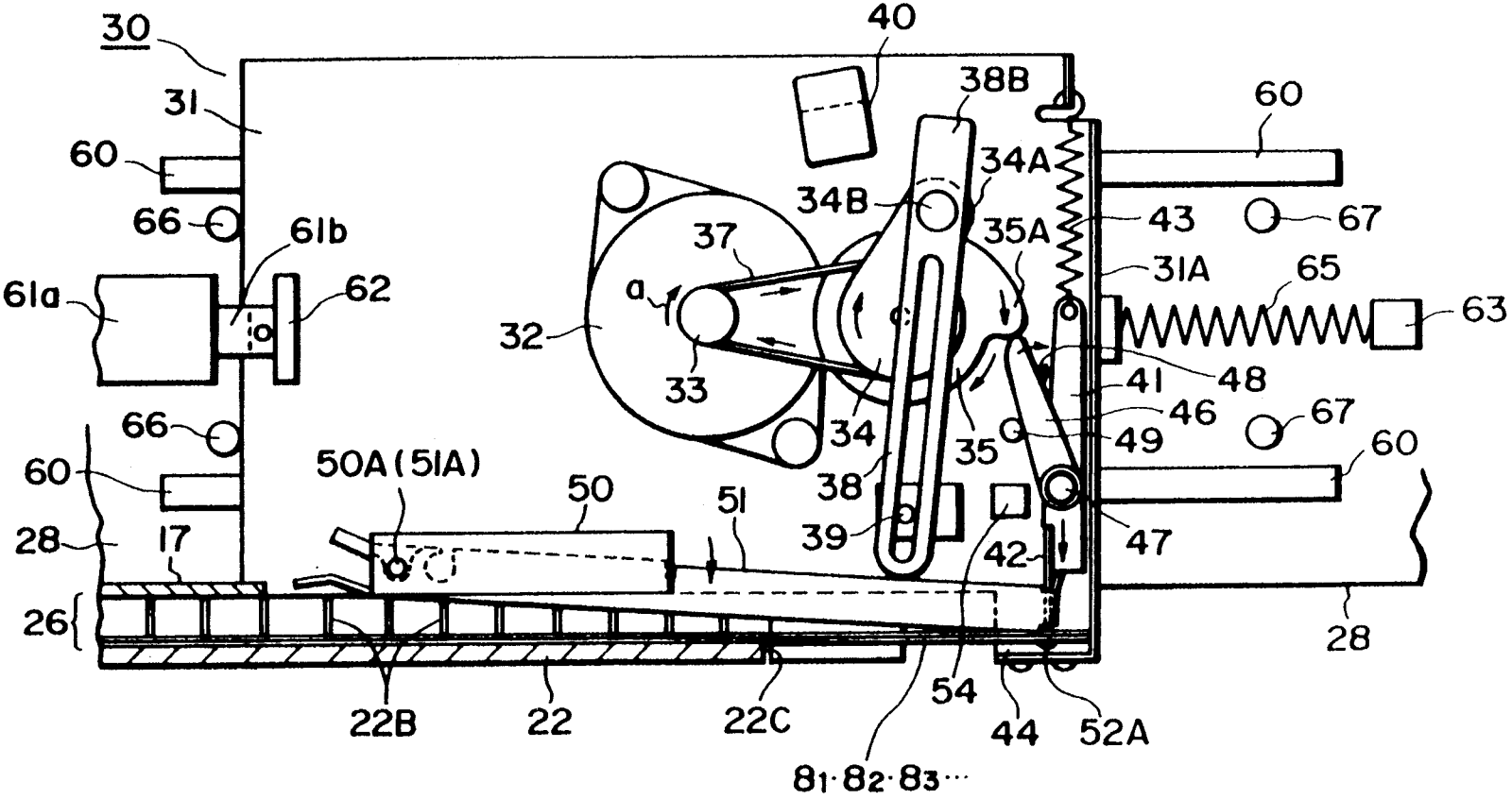

If the result of the discrimination shows that the paper width is B4 width, the solenoid 61*a* is maintained deenergized, so that the base plate 31, and therefore, the stapler unit 30 is maintained at, or moved to and then maintained at the second position. In this state, the anvil 44 of the stapler unit 30, as shown in FIGS. 18 and 19 by chain lines, is opposed to the outside position corresponding to the leading edge right corner of the discharged sheets having B4 width and received by the cavity 26 functioning as the stacker with their leading edges abutted to the bottom surface 22B functioning as the stopper member. As described hereinbefore, the slider 41, and therefore, the staple hammer 42 advance to push out the first staple 52*a*, so that the legs thereof penetrate the sheets $8_1$, $8_2$, $8_3$ . . . and are bent inwardly toward each other by the anvil 44. That is, the sheets are stapled. FIG. 20 shows the state wherein the staple has been shot. In this manner, the plural output sheets $8_1$, $8_2$, $8_3$ . . . which should constitute a set are stapled at the upper left corner.

Figure 21:
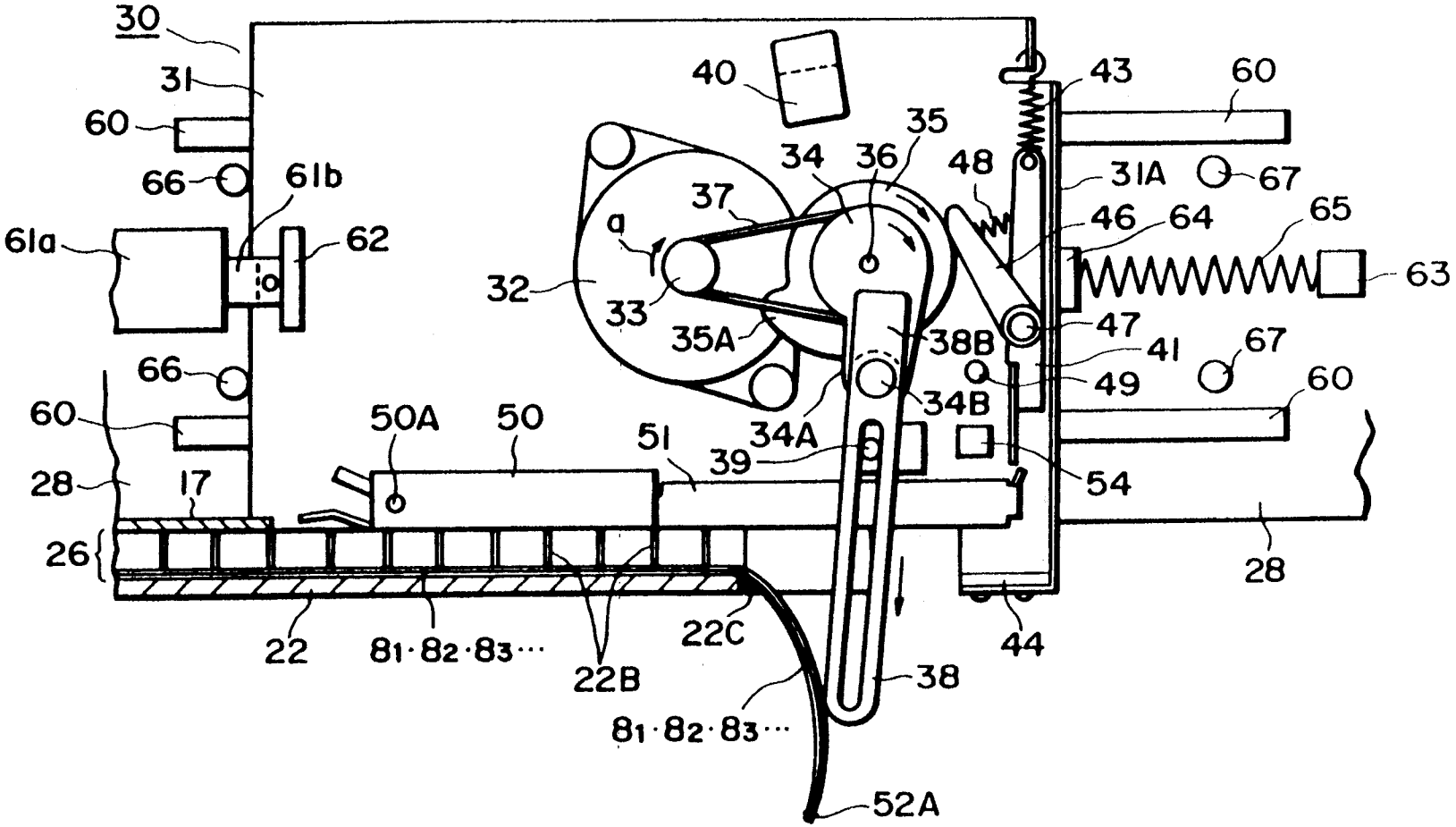

FIG. 21 shows a state wherein the stapled portion of the set of the sheets are pushed out.

As described, according to this embodiment, the detecting means detects the width of the used paper, that is, the width of the sheets to be discharged, and in response to the detection, the sheet binding means is shifted to a position where it can property bind the discharged sheets having the detected size. Accordingly, plural discharged sheets which should constitute a set are properly bound irrespective of the width of the-discharged sheets.

While the invention has been described with reference to the structures disclosed herein, it is not confined to the details set forth and this application is intended to cover such modifications or changes as may come within the purposes of the improvements or the scope of the following claims.

What is claimed is:

1. A method of controlling a sheet material discharging apparatus with sheet material binding means, comprising the steps of:

accommodating each of plural sheet materials sequentially discharged from the sheet material discharging apparatus with at least one edge of the plural sheet materials controlled so as to be aligned; and operating the sheet material binding means to bind, at a position where the sheet materials are accommodated by said accommodating step, two or more of the plural sheet materials discharged by the discharging apparatus, the sheet materials being aligned and overlaid with one another, wherein during discharge of sheet materials which together constitute a set of sheet materials, the binding means operates to bind the set of sheet materials without waiting for a trailing edge of the last one of the sheet materials of the set to be discharged, once a leading edge of the last one of the sheet materials is discharge and aligned in said accommodating step.

2. A method according to claim 1, wherein it is determined whether the leading edge is aligned or not on the basis of a count of one-line feeds of the sheet.

3. A method of controlling a sheet material discharging apparatus with sheet material binding means, comprising the steps of:

accommodating each of plural sheet materials sequentially discharged from the sheet material discharging apparatus;

operating the sheet material binding means to bind, at a position where the sheet materials are accommodated by said accommodating step, two or more of the plural sheet materials discharged by the discharging apparatus, the sheet materials being aligned and overlaid with one another;

detecting a resetting of the binding means to a standby state; and permitting the operation of the discharging operation when the resetting is not detected within a predetermined period after operation of the binding means is instructed.

4. A method according to claim 3, further comprising the step of displaying a non-resetting of the binding means after the discharging operation.

* * * * *

UNITED STATES PATENT AND TRADEMARK OFFICE

CERTIFICATE OF CORRECTION

PATENT NO. : 5,342,033

DATED : August 30, 1994

INVENTOR(S) : MASAKATSU IWATA, ET AL.

It is certified that error appears in the above-indentified patent and that said Letters Patent is hereby corrected as shown below:

Column 1

Line 53, "and" should read --are--; and

Line 67, "sender" should read --senders--.

Column 2

Line 10, "are" should read --is--; and

Line 52, "view" should read --views--.

Column 3

Line 21, "leading" should read --reading-- and "reading" should read --leading--; and Line 45, "press-contacted" should read --press-contact--.

Column 4

Line 16, "a" should be deleted; and

Line 28, "pedestall" should read --pedestal--.

Column 5

Line 38, "poped" should read --popped--.

UNITED STATES PATENT AND TRADEMARK OFFICE

CERTIFICATE OF CORRECTION

PATENT NO. : 5,342,033

DATED : August 30, 1994

INVENTOR(S) : MASAKATSU IWATA, ET AL.

It is certified that error appears in the above-indentified patent and that said Letters Patent is hereby corrected as shown below:

Column 6

Line 6, "sheet" should read --sheets--; and

Line 49, "wail" should read --wall--.

Column 7

Line 13, "a" (3rd occurrence) should be deleted.

Column 9

Line 6, ".of" should read --of--;

Line 9, "they" should read --it--;

Line 10, "degrees) upon" should read --degrees). Upon--; and

Line 31, "machine" should read --machine is--.

Column 10

Line 33, "transmit" should read --transmits--.

Column 12

Line 30, "reset" should read --resets--;

Line 54, "lake" should read --like--; and

Line 57, "remove" should read --removes--.

Column 13

Line 13, "replenish" should read --replenishes--;

Line 40, "fail" should read --fall--; and

Line 60, "sheets" should read --sheet--.

UNITED STATES PATENT AND TRADEMARK OFFICE

CERTIFICATE OF CORRECTION

PATENT NO. : 5,342,033

DATED : August 30, 1994

INVENTOR(S) : MASAKATSU IWATA, ET AL.

It is certified that error appears in the above-indentified patent and that said Letters Patent is hereby corrected as shown below:

Column 14
Line 33, "become" should read --becomes--.

Column 15
Line 4, "section." should read --section--; and
Line 5, "transmit" should read --transmits--.

Column 16
Line 14, "th" should read --the--; and
Line 19, "sheet" should read --sheets--.

Column 19
Line 31, "at" should read --as--.

Column 20
Line 37, "property" should read --properly--; and
Line 41, "the-discharged" should read --the discharged--.

Column 21
Line 1, "discharge" should read --discharged--.

Signed and Sealed this

Seventh Day of March, 1995

Bruce Lehman

BRUCE LEHMAN

*Commissioner of Patents and Trademarks*

*Attest:*

*Attesting Officer*